US010242655B1

(12) United States Patent
Sato et al.

(10) Patent No.: US 10,242,655 B1
(45) Date of Patent: Mar. 26, 2019

(54) ELECTRONIC MUSICAL INSTRUMENT, METHOD OF GENERATING MUSICAL SOUNDS, AND STORAGE MEDIUM

(71) Applicant: CASIO COMPUTER CO., LTD., Tokyo (JP)

(72) Inventors: Hiroki Sato, Tokyo (JP); Hajime Kawashima, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/129,575

(22) Filed: Sep. 12, 2018

(30) Foreign Application Priority Data

Sep. 27, 2017 (JP) ..... 2017-186957

(51) Int. Cl.
*G10H 7/02* (2006.01)
*G10H 7/00* (2006.01)

(52) U.S. Cl.
CPC ..... *G10H 7/02* (2013.01); *G10H 7/002* (2013.01); *G10H 7/006* (2013.01); *G10H 7/008* (2013.01)

(58) Field of Classification Search
CPC ..... G10H 7/02; G10H 7/002; G10H 7/006; G10H 7/008
USPC ..... 84/604–607
See application file for complete search history.

(56) References Cited

U.S. PATENT DOCUMENTS 5,522,010 A * 5/1996 Toyama ..... G10H 1/20 704/207
5,670,728 A * 9/1997 Ogai ..... G10H 7/06 84/603
5,714,704 A 2/1998 Suzuki et al.
5,717,818 A * 2/1998 Nejime ..... G10L 21/04 381/23.1
5,869,781 A * 2/1999 Kurata ..... G10H 1/04 84/603
5,974,015 A * 10/1999 Iizuka ..... G10H 1/0041 369/47.16

(Continued)

FOREIGN PATENT DOCUMENTS

JP H09-26791 A 1/1997
JP 2000-122668 A 4/2000

(Continued)

OTHER PUBLICATIONS

U.S. Appl. No. 16/046,861, filed Jul. 26, 2018.

*Primary Examiner* — David S Warren
(74) *Attorney, Agent, or Firm* — Chen Yoshimura LLP

(57) ABSTRACT

An electronic musical instrument includes a first memory storing a plurality of waveform data; and a second memory having a plurality of waveform buffer regions that respectively function as ring buffers, wherein one of a processor or a sound source executes the following: setting a plurality of threshold margin values respectively for the plurality of waveform buffer regions, at least some of the threshold margin values are different from each other; identifying, at a prescribed timing, among the plurality of waveform buffer regions, a waveform buffer region in which a waveform read margin calculated for said waveform buffer region reaches the threshold margin value set and assigned to said waveform buffer region; and stopping a sound that has been generated from the waveform data read from the waveform buffer region that is identified by the identified process.

9 Claims, 23 Drawing Sheets

(56) References Cited

U.S. PATENT DOCUMENTS 6,835,885 B1 * 12/2004 Kondo ..... G10H 1/40 84/612
6,982,904 B2 * 1/2006 Shiga ..... G06F 11/1068 365/185.09
7,105,735 B2 * 9/2006 Senoo ..... G10H 7/002 84/609
7,259,314 B2 * 8/2007 Kobayashi ..... G11B 20/10527 84/604
7,381,879 B2 * 6/2008 Tamura ..... G10H 7/004 84/604
8,837,752 B2 * 9/2014 Fujita ..... H04R 3/005 381/119
9,705,620 B2 * 7/2017 Clovis ..... H04J 3/0658
10,057,047 B2 * 8/2018 Bogdan ..... H03K 5/15013
10,083,682 B2 * 9/2018 Kojima ..... G10H 7/008
2001/0013270 A1 * 8/2001 Kumamoto ..... G10H 1/125 84/604
2004/0181655 A1 9/2004 Azuma
2006/0193601 A1 8/2006 Okada
2006/0225561 A1 * 10/2006 Kobayashi ..... G11B 20/10527 84/604
2012/0243711 A1 * 9/2012 Fujita ..... H04H 60/04 381/119
2015/0059559 A1 * 3/2015 Takasaki ..... G10H 3/146 84/615
2015/0122110 A1 * 5/2015 Nagasaka ..... G10H 7/02 84/604
2017/0098439 A1 * 4/2017 Kojima ..... G10H 7/008

FOREIGN PATENT DOCUMENTS

JP 2003-241755 A 8/2003
JP 2004-93732 A 3/2004
JP 2004-246145 A 9/2004
JP 2004-272851 A 9/2004
JP 2006-227110 A 8/2006

* cited by examiner

| Waveform Number | w | 0 | 1 | ... | 10 | ... | 31 | 32 | 33 | ... | 511 |
|---|---|---|---|---|---|---|---|---|---|---|---|
| Tone Color Number | tonen[w] | 0 | 0 | ... | 0 | ... | 0 | 1 | 1 | ... | 15 |
| Waveform Number within Tone Color | twn[w] | 0(1A) | 1(2A) | ... | 10(5B) | ... | 31 (Not Used) | 0(1A) | 1(1B) | ... | 31(9C) |
| Minimum Velocity | vmin[w] | 0 | 61 | ... | 80 | ... | 0 | 0 | 51 | ... | 122 |
| Maximum Velocity | vmax[w] | 60 | 127 | ... | 127 | ... | 0 | 50 | 100 | ... | 127 |
| Minimum Key Number | kmin[w] | 0 | 0 | ... | 100 | ... | 0 | 0 | 0 | ... | 96 |
| Maximum Key Number | kmax[w] | 40 | 40 | ... | 127 | ... | 0 | 20 | 20 | ... | 127 |
| Address from Start of Waveform Region | wave_ad[w] | 0000000H | 0000A00H | ... | 00F2000H | ... | 00FA000H | 00FA000H | 0103200H | ... | 98000000H |
| Waveform Size | wave_sz[w] | 00BA00H | 00C100H | ... | 013800H | ... | 000000H | 009200H | 01A000H | ... | 02C500H |
| Start Address | start_ad[w] | 000080H | 000004H | ... | 000243H | ... | 000000H | 000042H | 000115H | ... | 00115AH |
| Loop Address | loop_ad[w] | 00040AH | 00BB9EH | ... | 0112A0H | ... | 000000H | 008720H | 0114E5H | ... | 024856H |
| End Address | end_ad[w] | 0006BFH | 00C0E5H | ... | 011ED2H | ... | 000000H | 0091E8H | 019AE0H | ... | 02C4CEH |

FIG. 4

| Voice Number | v | 0 | 1 | ... | 255 |
|---|---|---|---|---|---|
| Voice Status<br>0...Not In Use<br>1...Generating Sound<br>2...Attenuating | vs[v] | 1 | 2 | ... | 0 |
| Waveform Buffer Start Address (Absolute) | sa[v] | 0000A04H | 008422AH | ... | 000000H |
| Waveform Buffer Loop Address (Absolute) | la[v] | 00C59EH | 0089E8CH | ... | 000000H |
| Waveform Buffer End Address (Absolute) | ea[v] | 00CAE5H | 008E2F4H | ... | 000000H |
| Transfer Data Pointer (Absolute) | tp[v] | 00C724H | 08897FH | ... | 000000H |
| Write Pointer (Relative to Buffer) | wp[v] | 004722H | 01320AH | ... | 000000H |
| Read Pointer (Relative to Buffer) | rp[v] | 00484EH | 012D89H | ... | 000000H |
| Waveform Read Margin | rm[v] | 0FFED4H | 000481H | ... | 000000H |

FIG. 5

ELECTRONIC MUSICAL INSTRUMENT, METHOD OF GENERATING MUSICAL SOUNDS, AND STORAGE MEDIUM

BACKGROUND OF THE INVENTION

Technical Field

The present invention relates to an electronic musical instrument, a method of generating musical sounds, and a storage medium.

Background Art

Some musical sound generation devices that generate musical sound waveforms by reading waveform data employ a system in which in order to make it possible to use a larger number of waveforms as well as waveform data of a greater length, unused waveform data is stored in tone color waveform regions of a secondary storage device (first memory) such as read-only memory (ROM), flash memory, or a hard disk storage device, and sounds are generated by transferring the waveform data to be used to a primary storage device (second memory) such as random-access memory (RAM), which functions as a high-speed waveform buffer that a sound source large-scale integrated circuit (LSI) can access directly. This, in other words, enables a cost-effective approach in which waveform data of a size greater than the storage capacity of the higher-cost RAM is stored in the lower-cost ROM, and then that waveform data is transferred to the waveform buffer for use in sound production only when necessary.

However, musical sound waveform data can vary considerably in size, and although ideally it would be preferable for regions large enough to be able to store the respective waveform data for all sound production channels as-is to be prepared in the waveform buffer of the second memory, in reality, regions large enough to do this are not prepared in the waveform buffer of the second memory in order to keep costs down. Therefore, the waveform buffer is made to function as a so-called ring buffer that eliminates concerns related to the size of the musical sound waveform data, and as a sound source LSI repeatedly reads a prescribed region of the waveform buffer (ring buffer region) corresponding to the target sound production channel while a sound emitter is emitting sound, a CPU sequentially replaces the waveform data in the waveform buffer. One example of a well-known conventional technology is the technology disclosed in Patent Document 1.

Here, the speed at which a write address (write pointer) is advanced as the CPU transfers waveform data from the first memory must be significantly greater than the speed at which a read address (read pointer) is advanced as the sound source LSI reads waveform buffer from the second memory in order to play waveforms. However, structurally, if the playback pitch used in the sound source LSI becomes higher, the read speed increases, and if the number of sounds simultaneously being produced increases, the average waveform transfer speed per voice decreases. When these two unfavorable conditions occur at the same time, the need to prevent the write pointer from passing the read pointer in the waveform buffer becomes a secondary concern next to the fact that the write pointer itself may actually get passed by the read pointer. If this happens, the waveform being read by the sound source LSI suddenly and non-continuously returns to being past data, thereby resulting in noise. From a musical perspective, such noise is unacceptable. Therefore, conventionally, there has been a need to monitor a margin (hereinafter, a "waveform read margin") calculated by subtracting the read pointer from the write pointer for each waveform buffer corresponding to a sound production channel, and to then, for any sound production channel for which this waveform read margin becomes too small, immediately execute a silencing process in order to prevent a musically unacceptable sound from being emitted.

Patent Document 1: Japanese Patent Application Laid-Open Publication No. 2000-122668

However, in conventional technologies, when transferring waveform data in the first memory to a waveform buffer in the second memory which is assigned to a respective sound production channel among the plurality of sound production channels, the waveform read margins for the waveform buffers corresponding to the respective sound production channels are all compared against the same threshold value. Therefore, the greater the read speed for a given waveform buffer becomes, the greater the probability becomes that once the waveform read margin decreases to less than the threshold value, the read pointer will catch up to the write pointer without there having been enough time to complete the transfer process while proceeding towards silence, thereby causing a musically unacceptable sound to be emitted.

Moreover, in implementing the waveform transfers to the waveform buffers for each sound production channel, conventional technologies utilize approaches such as transferring a fixed amount of waveform data to each waveform buffer in order regardless of the status of the associated sound production channels, or continuing to transfer waveform data to each waveform buffer in order one by one until just before the write pointer passes the read pointer. As a result, discrepancies arise between the amounts of waveform data stored in each waveform buffer, which can cause the associated sound production channels to get silenced in an undesirable manner if the transfer load becomes too high.

Furthermore, in conventional technologies, even when the amount of waveform data requested by the sound source LSI exceeds the maximum waveform transfer capacity of the musical sound generation device, the waveform data continues to be transferred. Therefore, sound production channels get silenced simply according to which have the smallest waveform read margins and without regard for the importance or the like of the associated sounds, which can potentially result in important sounds getting silenced before other less important sounds.

In light of the foregoing, the present invention aims to make it possible to prevent production of musically unacceptable sounds.

SUMMARY OF THE INVENTION

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides an electronic musical instrument, including: a first memory storing a plurality of waveform data; a second memory having a plurality of waveform buffer regions that respectively function as ring buffers; a processor that executes a transfer process of transferring the waveform data stored in the first memory to the waveform buffer regions in the second memory; and a sound source that executes a read process of reading waveform data from the plurality of waveform buffer regions in the second memory and causing a plurality of sounds to be generated simultaneously based on the waveform data read from the plurality of waveform buffer regions in the second memory, the transfer process by the processor and the read process by the sound source being executed in a ring buffer operational manner using the waveform buffer regions as ring buffers, respectively, wherein each of the following processes is executed by the processor or the sound source: a threshold margin value setting process of setting a plurality of threshold margin values respectively for the plurality of waveform buffer regions, the plurality of threshold margin values being settable to values specific to the corresponding waveform buffer regions and at least some of the threshold margin values are different from each other; an identification process of identifying, at a prescribed timing, among the plurality of waveform buffer regions, a waveform buffer region in which a waveform read margin calculated for the waveform buffer region reaches the threshold margin value set and assigned to the waveform buffer region, the waveform read margin being calculated for each waveform buffer region at the prescribed timing based on a transfer position in the waveform buffer region to which the processor is transferring waveform data from the first memory at the prescribed timing and a read position in the waveform buffer region from which the sound source is reading waveform data in the read processes; and a sound generation stopping process of stopping a sound that has been generated from the waveform data read from the waveform buffer region that is identified by the identified process, thereby stopping the read process on the identified waveform buffer region by the sound source.

In another aspect, the present disclosure provides a method executed by an electronic musical instrument that includes: a first memory storing a plurality of waveform data; a second memory having a plurality of waveform buffer regions that respectively function as ring buffers; a processor that executes a transfer process of transferring the waveform data stored in the first memory to the waveform buffer regions in the second memory; and a sound source that executes a read process of reading waveform data from the plurality of waveform buffer regions in the second memory and causing a plurality of sounds to be generated simultaneously based on the waveform data read from the plurality of waveform buffer regions in the second memory, the transfer process by the processor and the read process by the sound source being executed in a ring buffer operational manner using the waveform buffer regions as ring buffers, respectively, the method including: causing one of the processor and the sound source to execute a threshold margin value setting process of setting a plurality of threshold margin values respectively for the plurality of waveform buffer regions, the plurality of threshold margin values being settable to values specific to the corresponding waveform buffer regions and at least some of the threshold margin values are different from each other; causing one of the processor and the sound source to execute an identification process of identifying, at a prescribed timing, among the plurality of waveform buffer regions, a waveform buffer region in which a waveform read margin calculated for the waveform buffer region reaches the threshold margin value set and assigned to the waveform buffer region, the waveform read margin being calculated for each waveform buffer region at the prescribed timing based on a transfer position in the waveform buffer region to which the processor is transferring waveform data from the first memory at the prescribed timing and a read position in the waveform buffer region from which the sound source is reading waveform data in the read processes; and causing one of the processor and the sound source to execute a sound generation stopping process of stopping a sound that has been generated from the waveform data read from the waveform buffer region that is identified by the identified process, thereby stopping the read process on the identified waveform buffer region by the sound source.

In another aspect, the present disclosure provides a computer-readable non-transitory storage medium having stored thereon a program to be executable by an electronic musical instrument that includes: a first memory storing a plurality of waveform data; a second memory having a plurality of waveform buffer regions that respectively function as ring buffers; a processor that executes a transfer process of transferring the waveform data stored in the first memory to the waveform buffer regions in the second memory; and a sound source that executes a read process of reading waveform data from the plurality of waveform buffer regions in the second memory and causing a plurality of sounds to be generated simultaneously based on the waveform data read from the plurality of waveform buffer regions in the second memory, the transfer process by the processor and the read process by the sound source being executed in a ring buffer operational manner using the waveform buffer regions as ring buffers, respectively, the program causing the electronic musical instrument to perform the following: causing one of the processor and the sound source to execute a threshold margin value setting process of setting a plurality of threshold margin values respectively for the plurality of waveform buffer regions, the plurality of threshold margin values being settable to values specific to the corresponding waveform buffer regions and at least some of the threshold margin values are different from each other; causing one of the processor and the sound source to execute an identification process of identifying, at a prescribed timing, among the plurality of waveform buffer regions, a waveform buffer region in which a waveform read margin calculated for the waveform buffer region reaches the threshold margin value set and assigned to the waveform buffer region, the waveform read margin being calculated for each waveform buffer region at the prescribed timing based on a transfer position in the waveform buffer region to which the processor is transferring waveform data from the first memory at the prescribed timing and a read position in the waveform buffer region from which the sound source is reading waveform data in the read processes; and causing one of the processor and the sound source to execute a sound generation stopping process of stopping a sound that has been generated from the waveform data read from the waveform buffer region that is identified by the identified process, thereby stopping the read process on the identified waveform buffer region by the sound source.

It is to be understood that both the foregoing general description and the following detailed description are exemplary and explanatory, and are intended to provide further explanation of the invention as claimed.

BRIEF DESCRIPTION OF THE DRAWINGS

The present invention will be more deeply understood with reference to the following detailed descriptions with the accompanying drawings.

FIG. 4 illustrates an example of data in a flash memory tone color waveform directory.

FIG. 5 illustrates an example of data in a RAM waveform buffer directory.

DETAILED DESCRIPTION OF THE PREFERRED EMBODIMENTS

Embodiments of the present invention will be described in detail below with reference to figures. The present embodiment relates to a musical sound generation device for use in an electronic keyboard instrument, for example, which, in order to reproduce changes in tone color in accordance with performance information such as pitch (key region) and volume (velocity: the speed at which a key is pressed), transfers waveform data ("split waveforms") for each pitch and volume from tone color waveform regions in a first memory constituted by a high-capacity flash memory 208, for example, to a plurality of waveform buffer regions in a second memory constituted by a RAM 204, for example.

Figure 1:
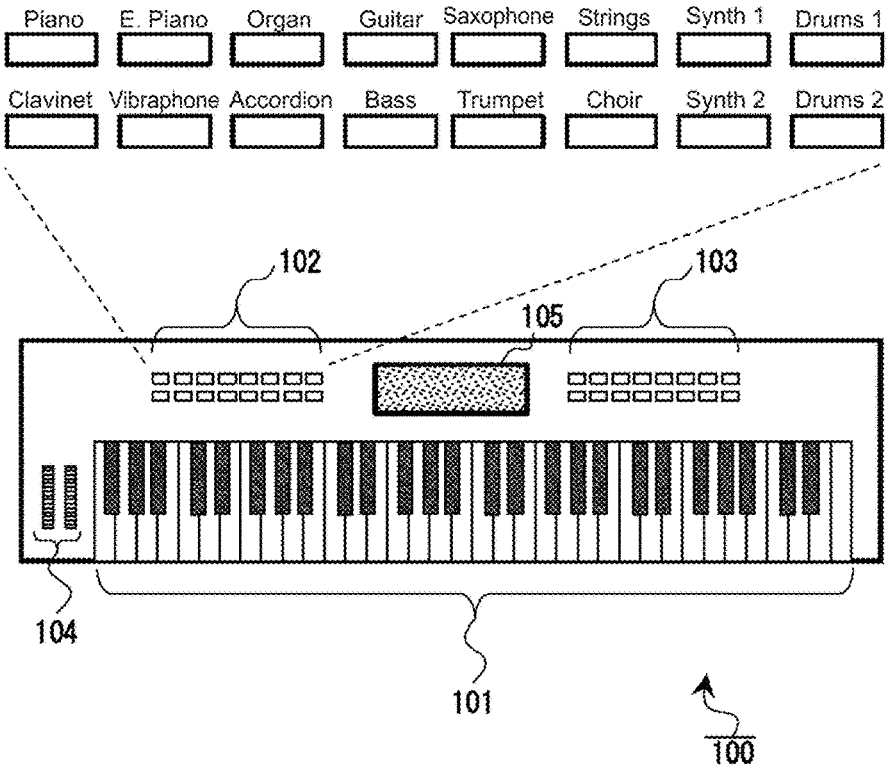
FIG. 1 is an external view of an embodiment of an electronic keyboard instrument according to the present invention.

FIG. 1 is an external view of an embodiment of an electronic keyboard instrument according to the present invention. The present embodiment is implemented as an electronic keyboard instrument 100. The electronic keyboard instrument 100 includes: a keyboard 101 including a plurality of keys (performance operation elements); a switch panel including tone color selection buttons (tone color selection elements) 102 for selecting tone color and feature selection buttons 103 for selecting various features other than tone color; bender/modulation wheels 104 which add various types of modulation (performance effects) such as pitch bending, tremolo, and vibrato; a liquid crystal display (LCD) 105 which displays tone color and information of various settings other than tone color; and the like. The electronic keyboard instrument 100 further includes, in a location such as the rear face, side faces, or back face thereof, speakers (not illustrated in the figure) which emit the musical sounds generated by a performance.

As illustrated in FIG. 1, the tone color selection buttons 102 are a group of buttons for selecting various tone color categories such as the tone color of a piano ("Piano" in the figure), an electronic piano ("E. Piano" in the figure), an organ ("Organ" in the figure), or a guitar ("Guitar" in the figure). The user can press these tone color selection buttons 102 to select any of 16 tone colors, for example.

Figure 2:
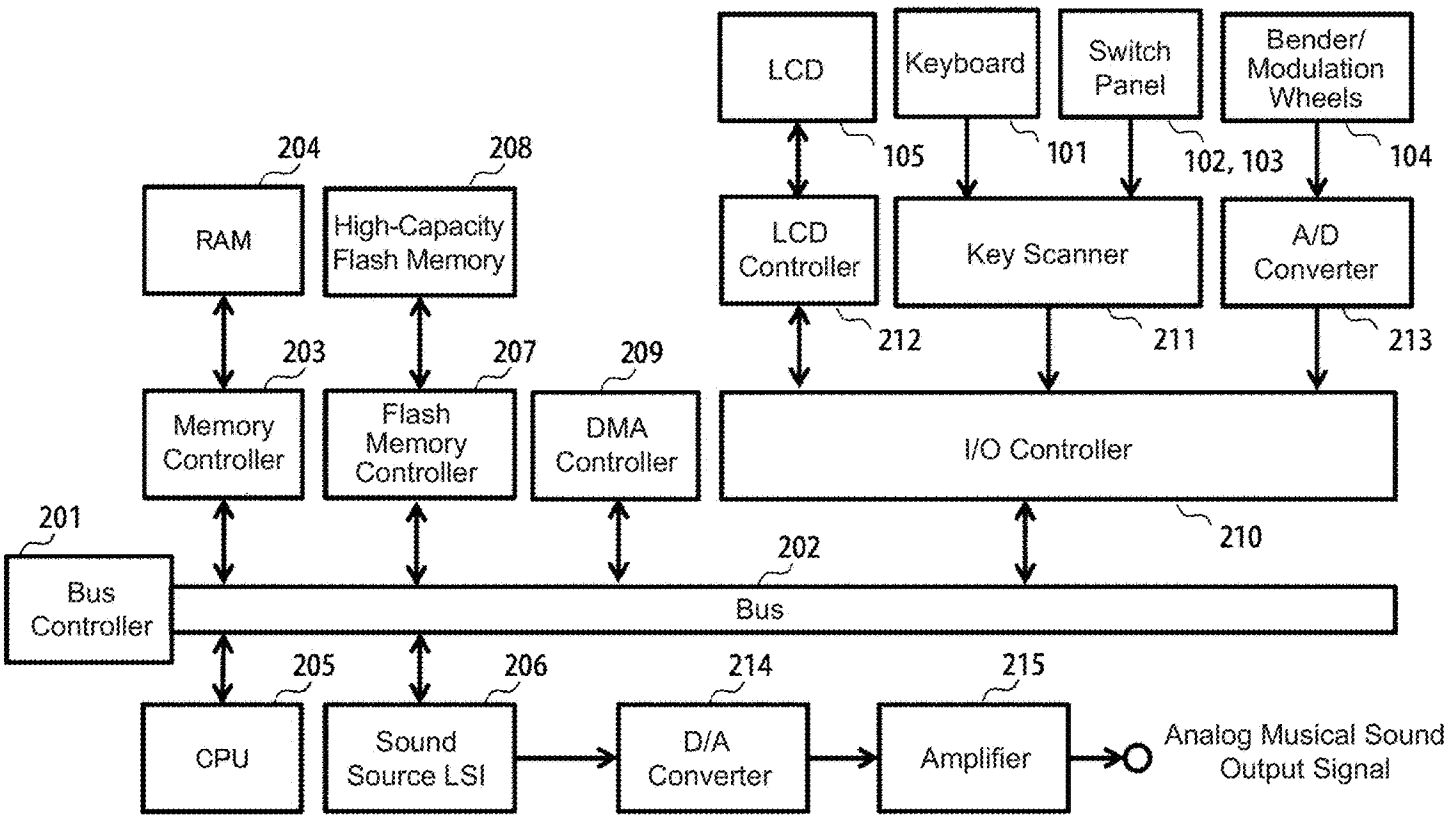
FIG. 2 illustrates an example of a hardware configuration for the embodiment of the electronic keyboard instrument.

FIG. 2 illustrates an example of a hardware configuration for the embodiment of the electronic keyboard instrument 100 illustrated in FIG. 1. In the electronic keyboard instrument 100 illustrated in FIG. 2, the overall system is configured around a bus 202 which is controlled by a bus controller 201. The bus controller 201 controls the flow of data over the bus 202 and serves to control the priority of devices connected to the bus 202. For example, the RAM 204 (second memory) connected to the bus 202 via a memory controller 203 is shared by a CPU 205 and a sound source LSI 206. However, whereas the sound source LSI 206 (which is responsible for generating sounds) is configured to have the highest priority because missing data would be unacceptable, access from the CPU 205 can be restricted as necessary.

The CPU 205, the sound source LSI 206, a flash memory controller 207, the memory controller 203, a direct memory access (DMA) controller 209, and an input/output (I/O) controller 210 are connected to the bus 202. Furthermore, a key scanner 211, an LCD controller 212, and an analog-to-digital (A/D) converter 213 are also connected to the bus 202 via the I/O controller 210.

The CPU 205 is a processor which executes an overall control process for the electronic keyboard instrument 100. The sound source LSI 206 is a sound source which is a large-scale integrated circuit dedicated for generating musical sounds.

The flash memory controller 207 is an interface circuit which connects the high-capacity flash memory 208 (first memory) to the bus 202. The high-capacity flash memory 208 stores waveform data, control programs, static data, and the like.

The memory controller 203 is an interface circuit which connects the RAM 204 to the bus 202. The RAM 204 stores waveform data, control programs, and other types of data on an as-needed basis. The RAM 204 is also used as a working region for the CPU 205 and a digital signal processor (DSP) which is built into the sound source LSI 206.

The I/O controller 210 is an interface circuit which connects peripheral devices such as the keyboard 101, the tone color selection buttons 102, the feature selection buttons 103, the bender/modulation wheels 104, and the LCD 105 illustrated in FIG. 1 to the bus 202. The key scanner 211 connected to the I/O controller 210 scans the state of the keyboard 101 and switch panel components such as the tone color selection buttons 102 and the feature selection buttons 103 illustrated in FIG. 1 and sends the obtained scanning results to the CPU 205 via the I/O controller 210 and the bus 202. The LCD controller 212 connected to the I/O controller 210 controls the LCD 105 device illustrated in FIG. 1. The A/D converter 213 detects the operation position of the bender/modulation wheels 104 illustrated in FIG. 1.

The DMA controller 209 controls DMA transfers between the high-capacity flash memory 208 and the RAM 204.

Figure 3:
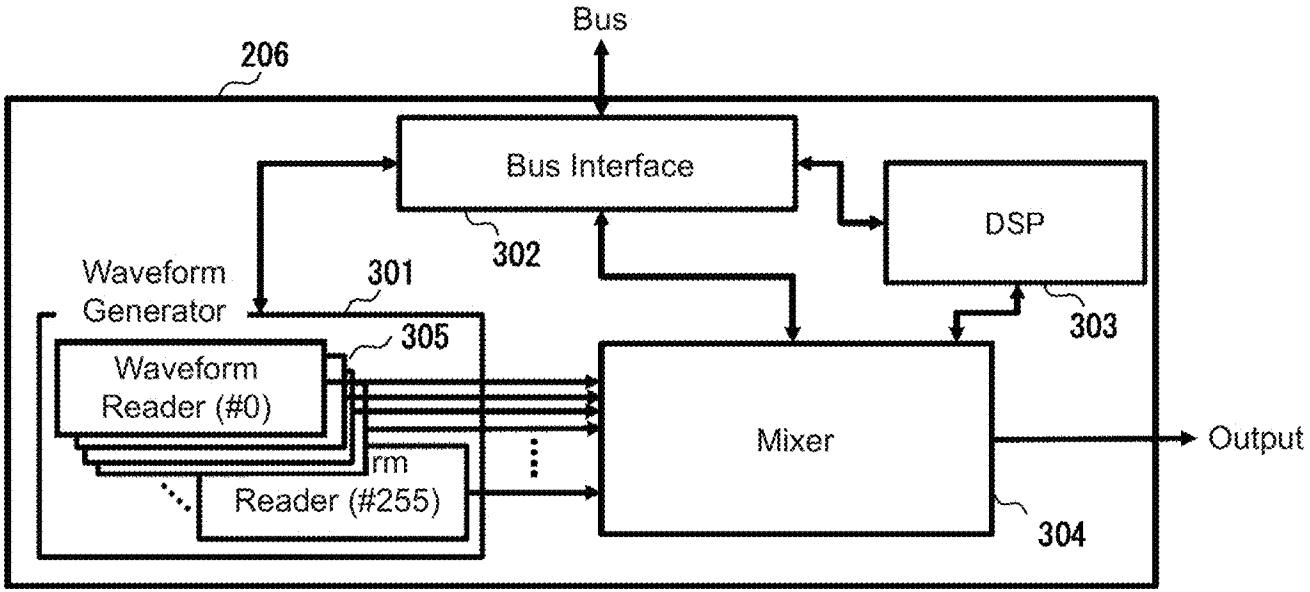
FIG. 3 is a block diagram of a sound source LSI.

FIG. 3 is a block diagram of the sound source LSI 206. The sound source LSI 206 includes a waveform generator 301, a bus interface 302, a DSP 303, and a mixer 304. The waveform generator 301 includes waveform readers 305 constituted by 256 oscillators numbered from #0 to #255 which read waveform data from the RAM 204 illustrated in FIG. 2 to generate musical sound waveforms. The bus interface 302 is a bus interface circuit which connects the waveform generator 301, the DSP 303, and the mixer 304 to the bus 202 and controls communication between these components and the CPU 205 and RAM 204 illustrated in FIG. 2. The DSP 303 is a digital signal processing circuit which applies audio effects to musical sound signals. The mixer 304 controls the overall flow of musical sound signals by mixing musical sound signals output by the waveform generator 301, sending these signals to the DSP 303, and receiving audio signals from the DSP 303, and then outputs the resulting signals to an external unit. The digital musical sound signals from the mixer 304 are converted to analog musical sound signals by a D/A converter 214 illustrated in FIG. 2. These analog musical sound signals are amplified by an amplifier 215 and then output as an analog musical sound output signal.

The high-capacity flash memory 208 illustrated in FIG. 2 is a high-capacity, low-cost memory device such as NAND flash memory. Note also that a hard disk storage device or a disk-based device on a network or the cloud may be used instead of this high-capacity flash memory 208. The high-capacity flash memory 208 primarily stores the following types of data:

- Waveform data for all tone colors
- Parameter data for all tone colors
- Programs executed by the CPU 205 and DSP 303, as well as data used by those programs
- Musical data
- User settings data The waveform data is linear PCM-formatted data with 16 bits per word, for example.

Although the CPU 205 can access any address of the abovementioned data stored in the high-capacity flash memory 208, the sound source LSI 206 cannot access this data, and therefore the waveform data in the high-capacity flash memory 208 must be transferred to the RAM 204. However, because the storage capacity of the RAM 204 is less than that of the high-capacity flash memory 208, it is not possible to transfer all of the data to buffer regions for each sound production channel in the RAM 204. Therefore, the data stored in the RAM 204 must be sequentially replaced as necessary. The present embodiment is particularly focused on the waveform data among this data that needs to be replaced, but the details of controlling this waveform data will be described later.

Next, the overall operation of the present embodiment as illustrated in FIGS. 1 to 3 will be described. First, in the present embodiment, a performer can press one of the tone color selection buttons 102 illustrated in FIG. 1 to select any of the 16 tone colors illustrated in FIG. 1. Each tone color uses a maximum of 32 types of waveforms per respective tone color, and this waveform data is stored in the high-capacity flash memory 208. The tone range (key numbers) and velocity range for each tone color are divided up two-dimensionally, and the abovementioned maximum of 32 waveforms are assigned to the respective split (divided) areas. In other words, a control process is executed to determine a single waveform that should be read on the basis of two factors: keypress speed (velocity) and key number (key number on the keyboard 101).

FIG. 4 illustrates an example of data in a flash memory tone color waveform directory. The flash memory tone color waveform directory is a table containing information about all of the waveform data stored in the high-capacity flash memory 208. More specifically, this table contains the following information: a "Minimum Key Number" field and a "Maximum Key Number" field (horizontal axis in FIG. 4) that define the key ranges respectively used by each waveform in each tone color as determined by a "Tone Color Number" field and a "Waveform Number within Tone Color" field; a "Minimum Velocity" field and a "Maximum Velocity" field (vertical axis in FIG. 4) that are the velocity range information respectively used by each of the waveforms; an "Address from Start of Waveform Region" field that indicates which address in the high-capacity flash memory 208 each waveform is actually stored at; a "Waveform Size" field that indicates the length of each waveform; and "Start Address", "Loop Address", and "End Address" fields that are used during read operations. This table is loaded into the RAM 204 when the power is turned on.

FIG. 5 illustrates an example of data in a RAM waveform buffer directory. The RAM waveform buffer directory is a table for storing information about the waveform buffers for each voice (oscillator) channel in the RAM 204. More specifically, this table stores the following information: a "Voice Status" field indicating the current status of each voice; "Waveform Buffer Start Address", "Waveform Buffer Loop Address", and "Waveform Buffer End Address" fields which are three pieces of address information about the waveforms to be read; a "Transfer Data Pointer" field which is the read address in the high-capacity flash memory 208 of the waveform which is currently being transferred by the CPU 205; a "Write Pointer" field which is the address in the RAM 204 to which data is transferred and written by the CPU 205; a "Read Pointer" field which is the address in the RAM 204 currently being read by the sound source LSI 206; and a "Waveform Read Margin" field which is the difference between the latest values of the write pointer and the read pointer.

Figure 6A:
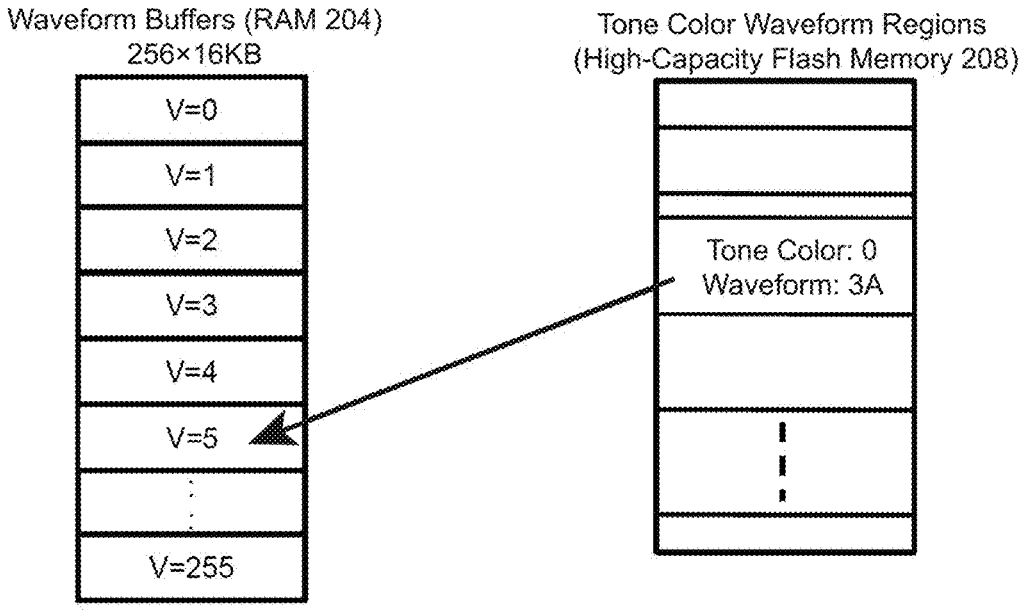
FIG. 6A is an explanatory drawing illustrating an operation for transferring tone color waveforms from tone color waveform regions in a high-capacity flash memory to waveform buffers in RAM.

FIG. 6A is an explanatory drawing of an operation for transferring tone color waveforms from the tone color waveform regions of the high-capacity flash memory 208 to the waveform buffers in the RAM 204. The high-capacity flash memory 208 stores the waveform data for all of the tone colors, and the size of each waveform is different. The waveform buffers allocated in the RAM 204 are equal in number to the number of sound production voice channels.

The size of these waveform buffers is fixed, and in the present embodiment each waveform buffer is 16 kilobytes (KB) in size.

Figure 6B:
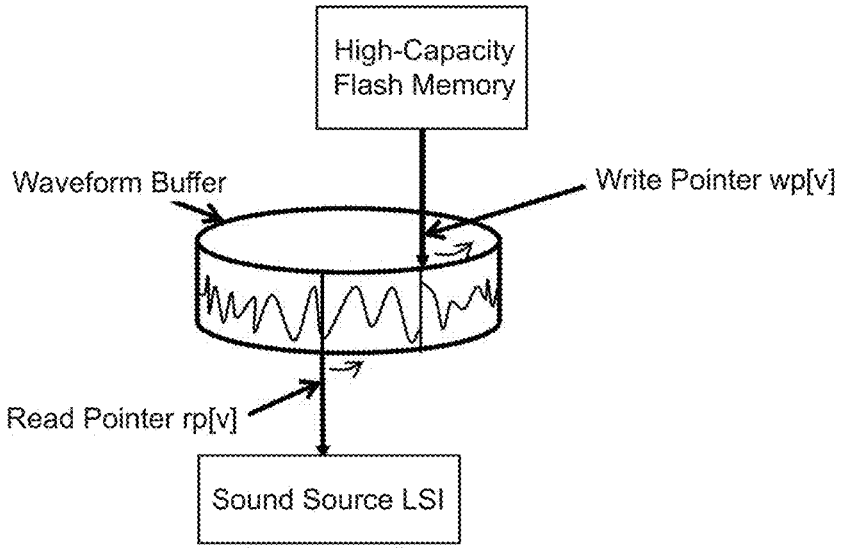
FIG. 6B is an explanatory drawing illustrating the operation of a ring buffer.

Here, each of the waveforms to be read exceeds 16 KB in size, and as a result it is not possible to transfer an entire waveform to one of the waveform buffers. Therefore, as illustrated in FIG. 6B, a given waveform buffer v takes a ring buffer format, and the sound source LSI 206 simply continues to repeatedly read a certain segment of that waveform buffer v from when sound production starts until when sound production finishes. To achieve this, the CPU 205, while also executing a control process to prevent the write pointer wp[v] (see FIG. 5) updated by the CPU 205 itself from passing the read pointer rp[v] (see FIG. 5) updated by the sound source LSI 206, continues transferring waveform data from a waveform memory w which is a tone color waveform region in the high-capacity flash memory 208 to the address indicated by the write pointer wp[v] in the waveform buffer v in the RAM 204 as the sound source LSI 206 continues reading.

Figure 7:
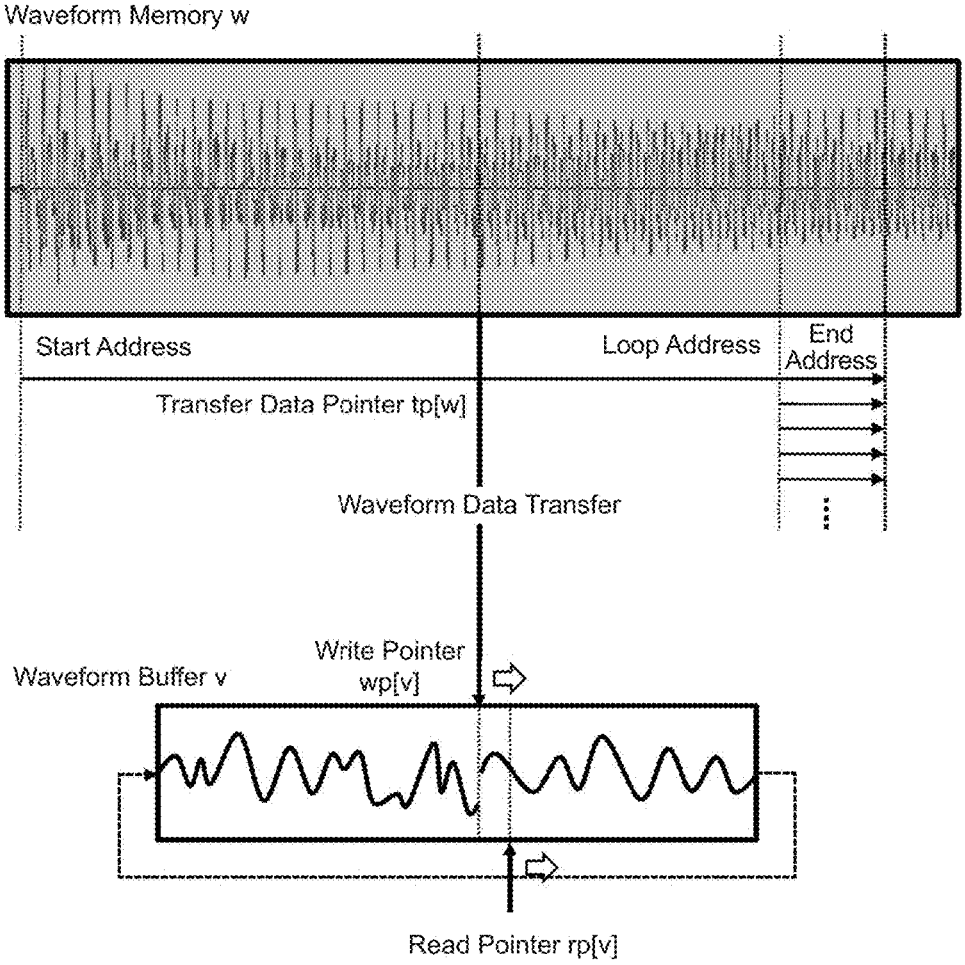
FIG. 7 is an explanatory drawing of a looped waveform transfer operation.

FIG. 7 is an explanatory drawing of a looped waveform transfer operation. Electronic musical instruments which utilize a waveform reading scheme commonly employ a looping technique in which a given segment of waveform data is read repeatedly in order to make it possible to continue reading a finite amount of waveform data indefinitely. More specifically, as illustrated in FIG. 7, in a waveform memory w in the high-capacity flash memory 208, during a waveform transfer a transfer data pointer tp[v] pointer (see FIG. 5) indicating a read address starts from a start address, and, upon reaching an end address, non-continuously returns to a loop address set to before the end address, and then upon reaching the end address returns to this loop address again. This behavior is then repeated indefinitely. In the present embodiment, as illustrated in FIG. 7, the CPU 205, while performing this looped read of waveform data from the high-capacity flash memory 208, sequentially writes the read waveform data as-is to a waveform buffer v which is a ring buffer. At this time, the address in the waveform memory w from which the CPU 205 is reading during the waveform data transfer is given by the transfer data pointer tp[v], the address in the waveform buffer v to which the CPU 205 is writing is given by the write pointer wp[v], and the address in the waveform buffer v from which the sound source LSI 206 is reading is given by the read pointer rp[v].

Figure 8:
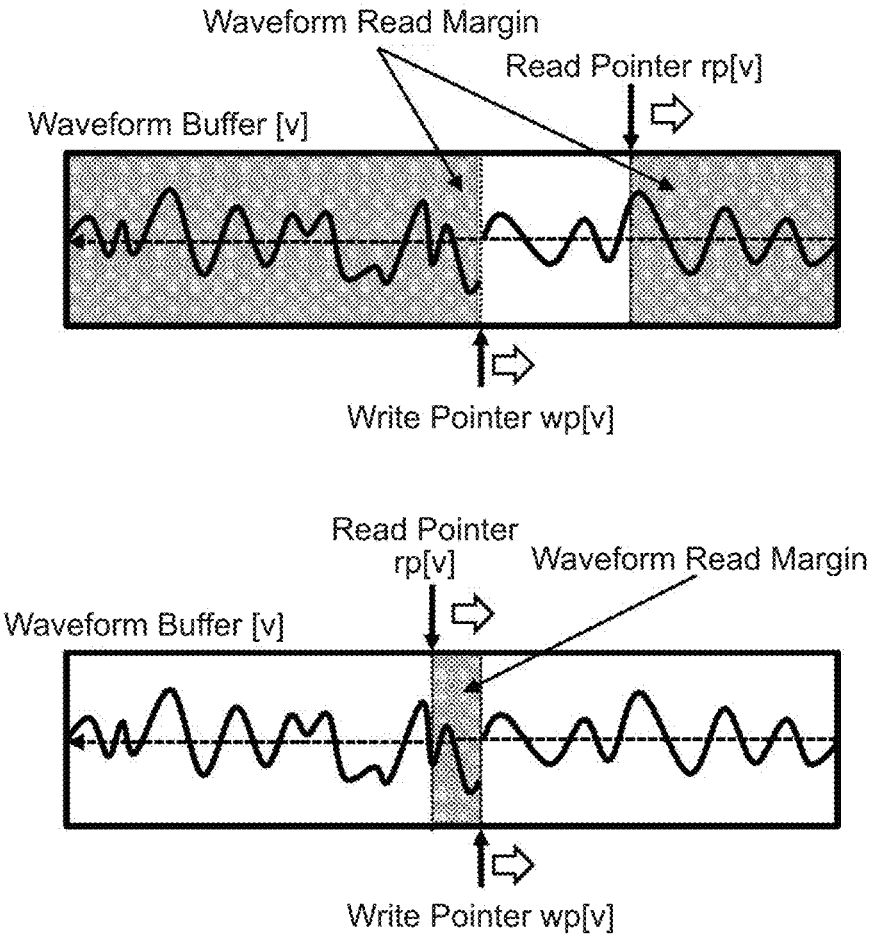
FIG. 8 is an explanatory drawing of a waveform read margin.

FIG. 8 is an explanatory drawing of a waveform read margin. In the present embodiment, the speed of advancement of the write pointer wp[v] indicating the address in the waveform buffer v to which the CPU 205 transfers and writes the waveform data that should be played from the waveform memory area in the high-capacity flash memory 208 must be significantly greater than the speed of advancement of the read pointer rp[v] indicating the address in the waveform buffer v from which the sound source LSI 206 is reading the waveform data for playback. However, structurally, if the playback pitch used in the sound source LSI 206 becomes higher, the read speed increases, and if the number of sounds simultaneously being produced increases, the average waveform transfer speed per voice decreases. When these two unfavorable conditions occur at the same time, the need to prevent the write pointer wp[v] from passing the read pointer rp[v] in the waveform buffer v becomes a secondary concern next to the fact that the write pointer wp[v] itself could actually get lapped and passed by the read pointer rp[v]. If this happened, the waveform being read by the sound source LSI 206 would suddenly and non-continuously returns to being past data, thereby resulting in noise. From a musical perspective, such noise is unacceptable.

Therefore, as illustrated in FIG. 8, in the present embodiment the number of words of data (addresses), i.e., the difference between the value of the write pointer wp[v] and the value of the read pointer rp[v], that indicates how many read pointer rp[v] within the waveform buffer v can be read without adding waveform data is managed as a waveform read margin. In the present embodiment, when this waveform read margin becomes less than or equal to a prescribed value, a muting process is applied to the voice sound production channel for emitting the associated musical sound, and then as soon as sound is no longer being emitted after that muting process having been applied, the reading from the waveform buffer v for that voice channel is stopped, thereby making it possible to prevent noise from occurring. Here, "muting process" refers to a process of smoothly silencing a musical sound that is currently being emitted within a short period of time.

In the present embodiment, the threshold value of the waveform read margin is not a fixed value and instead depends on the playback pitch. Here, the muting process is applied when the waveform read margin becomes less than one kiloword while playing at the pitch of the original sound, when the waveform read margin becomes less than two kilowords while playing at a pitch one octave higher, or when the waveform read margin becomes less than 512 words while playing at a pitch one octave lower.

With regard to the speed of the muting process, it is sufficient if the sound can be muted before the read margin portion of the waveform data that has already been transferred to the waveform buffer v is completely read even if the reading continues as-is without the waveform being replaced. This speed depends on the playback pitch.

Moreover, in the present embodiment, rather than the sound source LSI 206 simply continuing to read from the current waveform read address in the sound production channels for each voice as successively polled by the CPU 205, an interrupt can be configured to occur when the read pointer rp[v] advances to an address satisfying the condition described above. Therefore, this feature is used instead.

The basic operation of the present embodiment has been described above. Next, characteristic operations of the CPU 205 of the present embodiment illustrated in FIG. 2 will be described.

First, a first characteristic operation of the CPU 205 of the present embodiment will be described. To obtain the waveform read margins described with reference to FIG. 8, the CPU 205 first, for each waveform buffer v in the RAM 204, uses the write pointer wp[v] and the read pointer rp[v] for that waveform buffer v to perform the operation given by equation (1) below and thereby calculate the corresponding waveform read margin rm[v] (see FIG. 5).

$$rm[v]=wp[v]-rp[v] \tag{1}$$

Next, for each sound production channel n ($0 \le n \le 255$) corresponding to the waveform readers 305 numbered from #0 to which #255 as illustrated in FIG. 3, the CPU 205 compares the waveform read margin rm[v] calculated using equation (1) for the waveform buffer v in the RAM 204 corresponding to that sound production channel n to a threshold margin m[n] calculated using the operation given below by equation (2).

$$m[n]=F\times T\times W\times s[n] \tag{2}$$

Here, F is the waveform data sampling frequency, which is set to 44.1 kilohertz (KHz), for example. Each sample has a size of 1 byte, for example. Moreover, T is an overall transfer margin threshold for the sound production channels n ($0 \le n \le 255$) which represents the minimum time for which playback must remain possible even if a transfer from a waveform memory w in the high-capacity flash memory 208 to a waveform buffer v in the RAM 204 were to stop, and here T is set to 0.0025 seconds (2.5 milliseconds), for example. Furthermore, W represents a sampling time expressed in terms of the number of words (the unit of writing data to/reading data from the waveform buffer V), which here is set to 0.5 words/sample (byte), for example. Finally, s[n] ($0 \le n \le 255$) is the relative playback speed for each sound production channel n ($0 \le n \le 255$), which here is set as follows, for example.

When playing waveform data at the same pitch as in the original (recorded) sound: s[n]=1.0

When playing at a pitch one octave higher than that of the original sound: s[n]=2.0

When playing at a pitch one octave lower than that of the original sound: s[n]=0.5

When sound production is stopped: s[n]=0

Note that the pitch ratios relative to the original sound are not limited to being ±1 octave as described above and can take real number values. In this case, the playback speeds s[n] should be set to ratios corresponding to those real numbers.

In equation (2), the quantity F×T yields the number of samples of waveform data corresponding to the minimum time for which playback must remain possible even if a transfer from a waveform memory w in the high-capacity flash memory 208 to a waveform buffer v in the RAM 204 were to stop. Moreover, the quantity F×T×W represents that minimum required number of samples as converted to an equivalent minimum required number of words (the unit of reading/writing the waveform data). Furthermore, the quantity F×T×W×s[n] on the right-hand side of equation (2) represents that minimum required number of words as scaled in accordance with the relative playback speed ratio for the waveform data in the waveform buffer v for each sound production channel n.

Next, if the CPU 205 determines that the waveform read margin rm[v] is less than the threshold margin m[n] calculated using the operation given by equation (2) for a given sound production channel n, the CPU 205 issues a mute instruction for that sound production channel n to the waveform reader 305 (see FIG. 3) corresponding to that sound production channel n in the sound source LSI 206.

In the first characteristic operation performed by the CPU 205 of the present embodiment as described above, as the playback speed of the waveform data increases (that is, as the pitch of the musical sound to be played is higher than that of the original sound), the threshold margin m[n] calculated using equation (2) becomes larger than a standard threshold margin. In this case, the speed at which the read pointer rp[v] catches up with the write pointer wp[v] is greater even if the allowable range relative to the waveform read margin rm[v] is somewhat large, and therefore the muting determination is made at a threshold margin m[n] which is greater than normal. Thus, with the first characteristic operation of the present embodiment as performed by the CPU 205, even if the playback speed of the waveform data is high (that is, even if the pitch of the musical sound to be played is higher than that of the original sound), a sufficient margin for during the muting process can be maintained, thereby making it possible to prevent musically unacceptable sounds from being emitted.

On the other hand, in the first characteristic operation performed by the CPU 205 of the present embodiment described above, as the playback speed of the waveform data decreases (that is, as the pitch of the musical sound to be played is lower than that of the original sound), the threshold margin m[n] calculated using equation (2) becomes less than the standard threshold margin. In this case, the speed at which the read pointer rp[v] catches up with the write pointer wp[v] is decreased even if the allowable range relative to the waveform read margin rm[v] is smaller than normal, and therefore the muting determination is made at a threshold margin m[n] which is lower than normal. Thus, with the first characteristic operation of the present embodiment performed by the CPU 205, when the playback speed of the waveform data is low (that is, when the pitch of the musical sound to be played is lower than that of the original sound), the margin for during the muting process can be reduced by an amount proportional to the reduction in read speed, thereby making it possible to improve waveform data transfer efficiency while still keeping it possible to prevent musically unacceptable sounds from being emitted.

Next, a second characteristic operation of the CPU 205 of the present embodiment will be described. In the present embodiment, the CPU 205 searches among the waveform buffers v corresponding to the sound production channels n ($0 \le n \le 255$) for the waveform buffer for which the remaining playback time of the currently buffered waveform data is shortest, and then proceeds to transfer waveform data in a prioritized manner from a waveform memory w in the high-capacity flash memory 208 to the searched waveform buffer v.

More specifically, for each sound production channel n ($0 \le n \le 255$), with respect to the waveform buffer v corresponding to the sound production channel n, the CPU 205 uses the write pointer wp[v] and the read pointer rp[v] as well as the threshold margin m[n] calculated using the operation given above by equation (2) in order to calculate the remaining playback time for that sound production channel n.

Next, the CPU 205 sorts the sound production channels n ($0 \le n \le 255$) in order from shortest to longest by the calculated remaining playback times. Then, in a waveform transfer process, the CPU 205 executes transfer processes of transferring data from waveform memories w in the high-capacity flash memory 208 to the waveform buffers v in the RAM 204 in order according to the sorted sound production channels n. Here, in order to reduce overhead, in each transfer process the CPU 205 always successively transfers a prescribed minimum amount (such as 1 KB) of waveform data.

As described above, in the second characteristic operation of the present embodiment performed by the CPU 205, the amount of data stored in the waveform buffers v is converted to equivalent time values, and waveform transfers are performed in a prioritized manner starting from the waveform buffer v having the most urgent need. Thus, as transfers of the minimum amount of waveform data continue to be performed, deviations in playback time between the sound production channels n proceed to be eliminated. This averages the risk of a transfer not being completed in time across the sound production channels n ($0 \le n \le 255$) and thereby substantially eliminates any unnecessary muting. Moreover, although this approach can result in transfers being wasted when performed for sound production channels n for which waveform readings (and sound production) become unnecessary midway due to a key having been released, averaging the expected values of these transfer losses as well makes it possible to prevent large transfer losses and to achieve stable waveform transfers.

Next, a third characteristic operation of the CPU 205 of the present embodiment will be described. In the present embodiment, the CPU 205 performs the operation given below by equation (3) to calculate the transfer speed required (hereinafter, "required transfer speed" or "overall transfer rate") for all of the sound production channels n ($0 \le n \le 255$) corresponding to all of the waveform readers 305 numbered from #0 to #255 as illustrated in FIG. 3. Here, F, W, and s[n]=s[0] to s[255] have the same meanings as described above.

$$F \times W \times (s[0]+s[1]+\ldots+s[255]) \quad (3)$$

The CPU 205 then determines whether the required transfer speed calculated using the operation given by equation (3) exceeds a system transfer capacity A, which is configured in advance. Upon determining that the required transfer speed does exceed the transfer capacity A, the CPU 205 issues an instruction to apply the muting process to a waveform reader 305 (FIG. 3) within the sound source LSI 206 corresponding to the sound production channel for a selected voice. More specifically, the CPU 205 issues an instruction to apply the muting process to the waveform reader 305 within the sound source LSI 206 which corresponds to the sound production channel for the voice having the lowest priority, as determined on the basis of factors such as sound production start order and sound emission level, among all of the sound production channels n ($0 \le n \le 255$).

The CPU 205 then performs the operation given by equation (3) again to calculate the required transfer speed again, compares this speed to the waveform transfer capacity A, and proceeds to continue repeating this same process until the required transfer speed becomes less than or equal to the waveform transfer capacity A. Upon determining that the required transfer speed has become less than or equal to the waveform transfer capacity A, the CPU 205 stops applying the muting process described above.

In the third characteristic operation of the present embodiment performed by the CPU 205 as described above, the maximum waveform transfer capacity of the system and the amount of waveform data (that is, the required transfer speed) being requested by the sound source LSI 206 are continuously compared, and when it is determined that a transfer will not be completed in time if the current state continues, sound production begins to be stopped starting from the sounds with the least musical importance. This makes it possible to minimize the degree of musical damage associated even if sound production for a given number of sound production channels is stopped.

Figure 9:
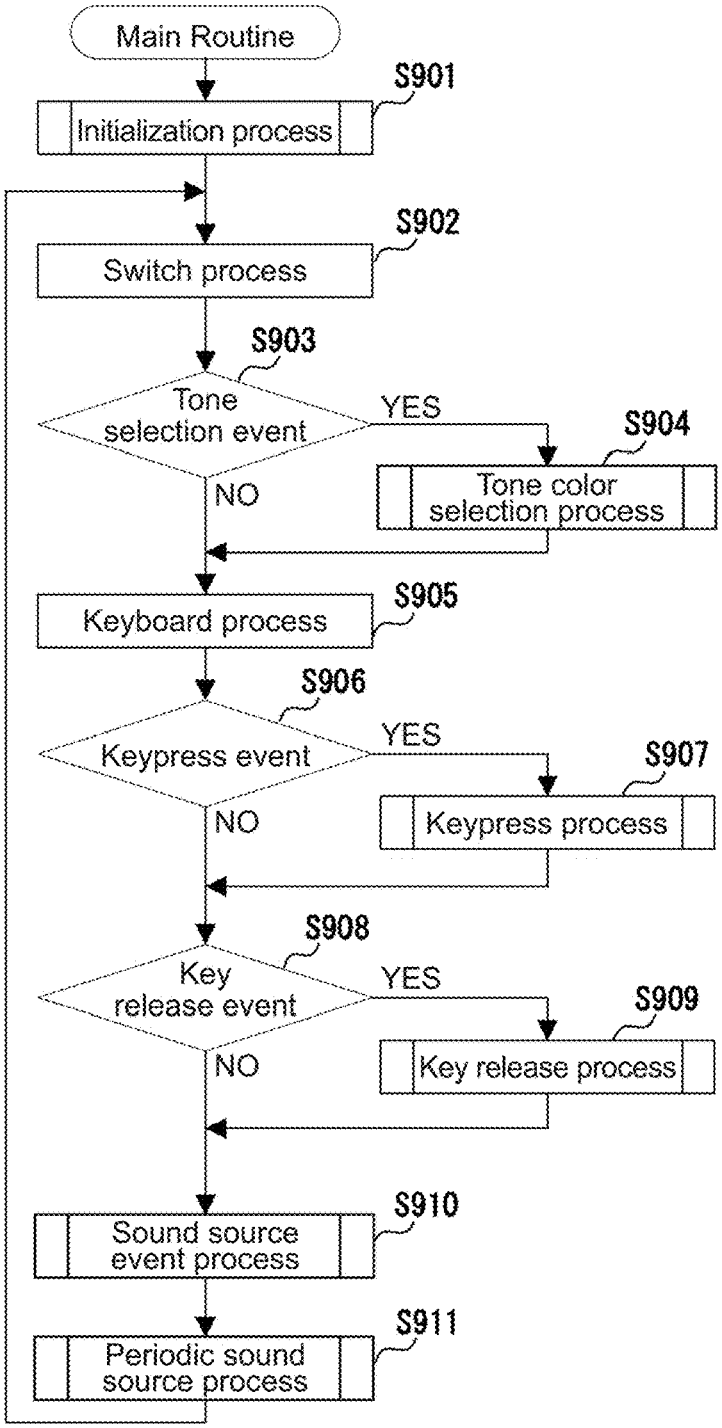
FIG. 9 is a flowchart illustrating an example of a main routine process.

Next, specific process examples of the present embodiments for achieving the operation described above will be described. FIG. 9 is a flowchart illustrating an example of a main routine process within the overall control process executed by the CPU 205 illustrated in FIG. 2. When the electronic keyboard instrument 100 illustrated in FIG. 1 is powered on using the feature selection buttons 103, the CPU 205 starts the main routine illustrated in the flowchart in FIG. 9 and executes an initialization process to initialize the components of the device (step S901). Once the initialization process in step S901 is complete, the following processes are repeatedly executed: a switch process of getting the user-configured operation states of the tone color selection buttons 102 and the feature selection buttons 103 illustrated in FIG. 1 (step S902); a process of, on the basis of the results of the process in step S902, detecting tone color selection events and selecting tone color when the tone color selection buttons 102 are operated (step S903→S904); a keyboard process of catching keypress events and key release events when the user plays the keyboard 101 illustrated in FIG. 1 (step S905); a keypress event detection and keypress process based on the results of the process in step S905 (step S906→S907); a key release event detection and key release process based on the results of the process in step S905 (step S908→S909); a sound source event process of processing events from the sound source LSI 206 (step S910); and a periodic sound source process of performing processes on the sound source LSI 206 at prescribed time intervals (step S911).

Figure 10A:
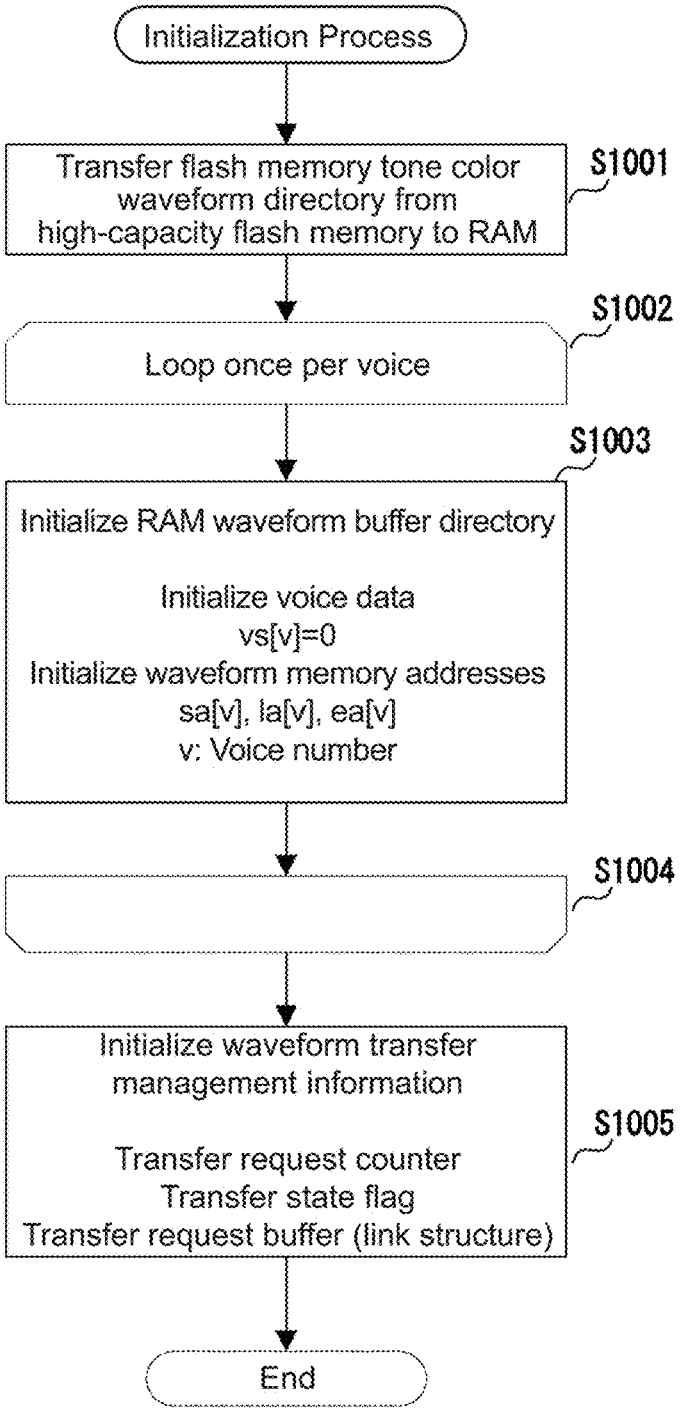
FIG. 10A is a flowchart illustrating a detailed example of an initialization process.

FIG. 10A is a flowchart illustrating a detailed example of the initialization process of step S901 in FIG. 9. First, the CPU 205 transfers the tabular data for the flash memory tone color waveform directory (see FIG. 4) from the high-capacity flash memory 208 to a specified address in the RAM 204 (step S1001).

Steps S1002 and S1004 respectively represent the beginning and the end of a looped process. Using repeating control processes in steps S1002 and S1004, a looped process is executed a number of times equal to the number of voices (the number of sound production channels n, $0 \le n \le 255$). In step S1003 of this looped process, a voice status vs[v] and a waveform buffer start address sa[v], a waveform buffer loop address la[v], and a waveform buffer end address ea[v] of a waveform buffer v corresponding to the voice number v are initialized.

Next, a transfer request counter, a transfer state flag, and a transfer request buffer (link structure) for managing transfer of waveforms from the tone color waveform regions w to the waveform buffers v are initialized (S1005). The transfer request counter tracks how many voices currently have a transfer underway, the transfer state flag is a flag indicating whether a transfer from a tone color waveform region to a waveform buffer is currently underway, and the transfer request buffer is a buffer for managing which voice for next to perform a waveform transfer from a tone color waveform region to a waveform buffer.

Figure 10B:
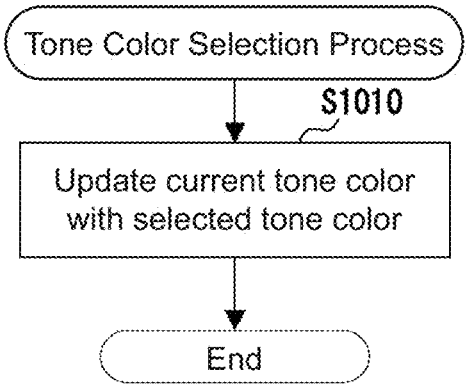
FIG. 10B is a flowchart illustrating a detailed example of a tone color selection process.

FIG. 10B is a flowchart illustrating a detailed example of the tone color selection process of step S904 in FIG. 9. In this process, the CPU 205 saves a tone color number specified by an operation of the tone color selection buttons 102 illustrated in FIG. 1 to a working region within the RAM 204 for later use in the keypress process or the like (step S1010).

Figure 11:
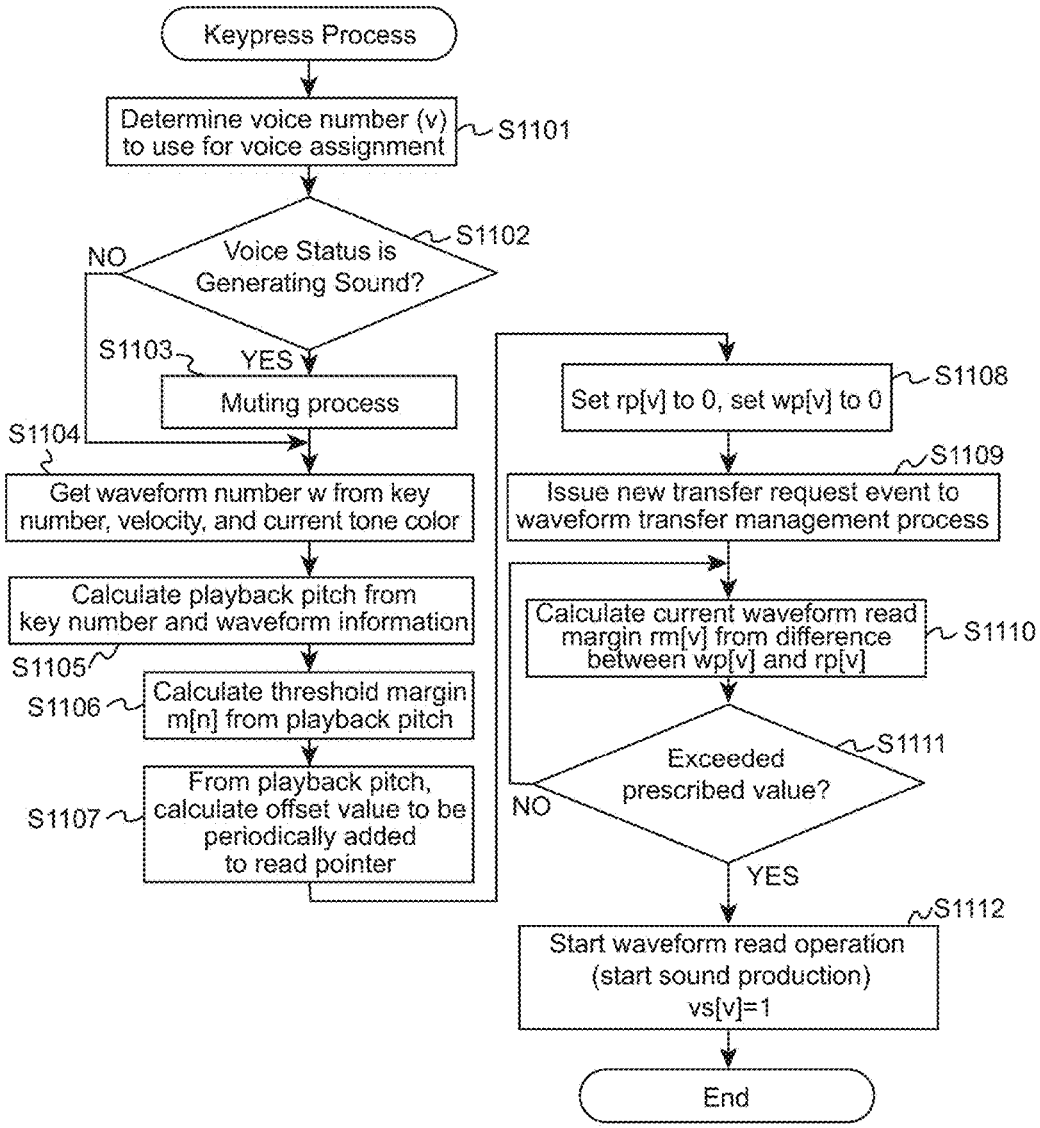
FIG. 11 is a flowchart illustrating a detailed example of a keypress process.

FIG. 11 is a flowchart illustrating a detailed example of the keypress process of step S907 in FIG. 9. Here, the CPU 205 converts performance information (keyboard position and keypress force) based on keypresses which occur as the keyboard is played to key numbers and velocities and then executes a control process based on these values.

First, the CPU 205 performs a voice assignment to determine which voice to use for sound production for the keypress (step S1101). In performing this assignment, the CPU 205 prioritizes voices having a voice number for which the voice status is Not In Use (vs[v]=0) in the RAM waveform buffer directory illustrated in FIG. 5 and stored in the RAM 204. If there is no choice but to assign a voice for which the voice status is Generating Sound (vs[v]=1) or Attenuating (vs[v]=2) (that is, if the determination in step S1102 yields YES), the CPU 205 executes the muting process (step S1103).

Next, based on the key number, velocity, and the current tone color number, the CPU 205 gets the waveform number w which should be transferred from the tone color waveform region to a waveform buffer (step S1104).

Then, the CPU 205 calculates a playback pitch based on the key number and waveform information obtained from the waveform number w (step S1105). Next, using the calculated playback pitch, the CPU 205 performs the operation given by equation (2) as described above to calculate the threshold margin m[n] (step S1106).

Then, the CPU 205 calculates an offset value which will be needed in an update process for the read pointer rp[v] and which will be periodically added to that read pointer rp[v] (step S1107).

Next, the CPU 205 sets the read pointer rp[v] and the write pointer wp[v] to 0 (step S1108).

Then, in order to perform a waveform transfer from a tone color waveform region to a waveform buffer, the CPU 205 issues a new transfer request to a waveform transfer management process and waits for the completion of the processes in that waveform transfer management process (step S1109).

Next, the CPU 205 performs the operation given by equation (1) as described above to calculate the current waveform read margin rm[v] (step S1110) and determines whether, once a waveform data transfer to a waveform buffer has been started by the waveform transfer management process in step S1109, the current waveform read margin rm[v] has exceeded a prescribed value (that is, repeats the sequence of step S1110→determination in step S1111 yields NO→step S1110). This, due to the relationship given by equation (1), provides a timing process which waits until the write pointer wp[v] (>0) is sufficiently far away from the read pointer rp[v] (=0).

Once the current waveform read margin rm[v] has exceeded the prescribed value (that is, once the determination in step S1111 yields YES), the CPU 205 starts a waveform read operation (that is, starts sound production) and sets the voice status (see FIG. 5) to Generating Sound (vs[v]=1) (step S1111→S1112). Finally, the CPU 205 ends the keypress process of step S907 in FIG. 9, which is illustrated in the flowchart in FIG. 11.

Figure 10C:
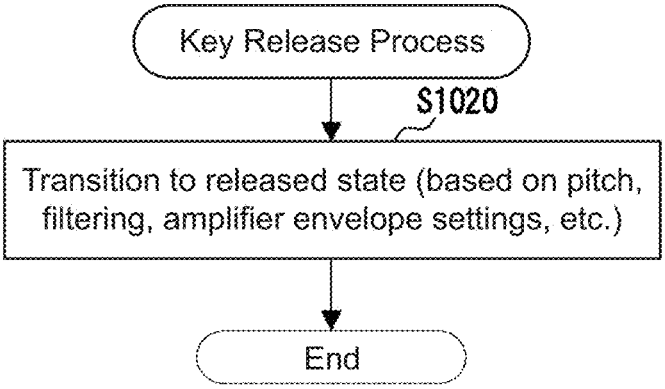
FIG. 10C is a flowchart illustrating a detailed example of a key release process.

FIG. 10C is a flowchart illustrating a detailed example of the key release process of step S909 in FIG. 9. Here, the CPU 205 converts performance information (keyboard position) associated with key releases that occur while playing the keyboard to key numbers and then executes a process for transitioning to a released state on the basis of factors such as pitch, filtering, and amplifier envelope settings (step S1020). After the process in step S1020, the CPU 205 ends the key release process of step S909 in FIG. 9, which is illustrated in the flowchart in FIG. 10.

Figure 12:
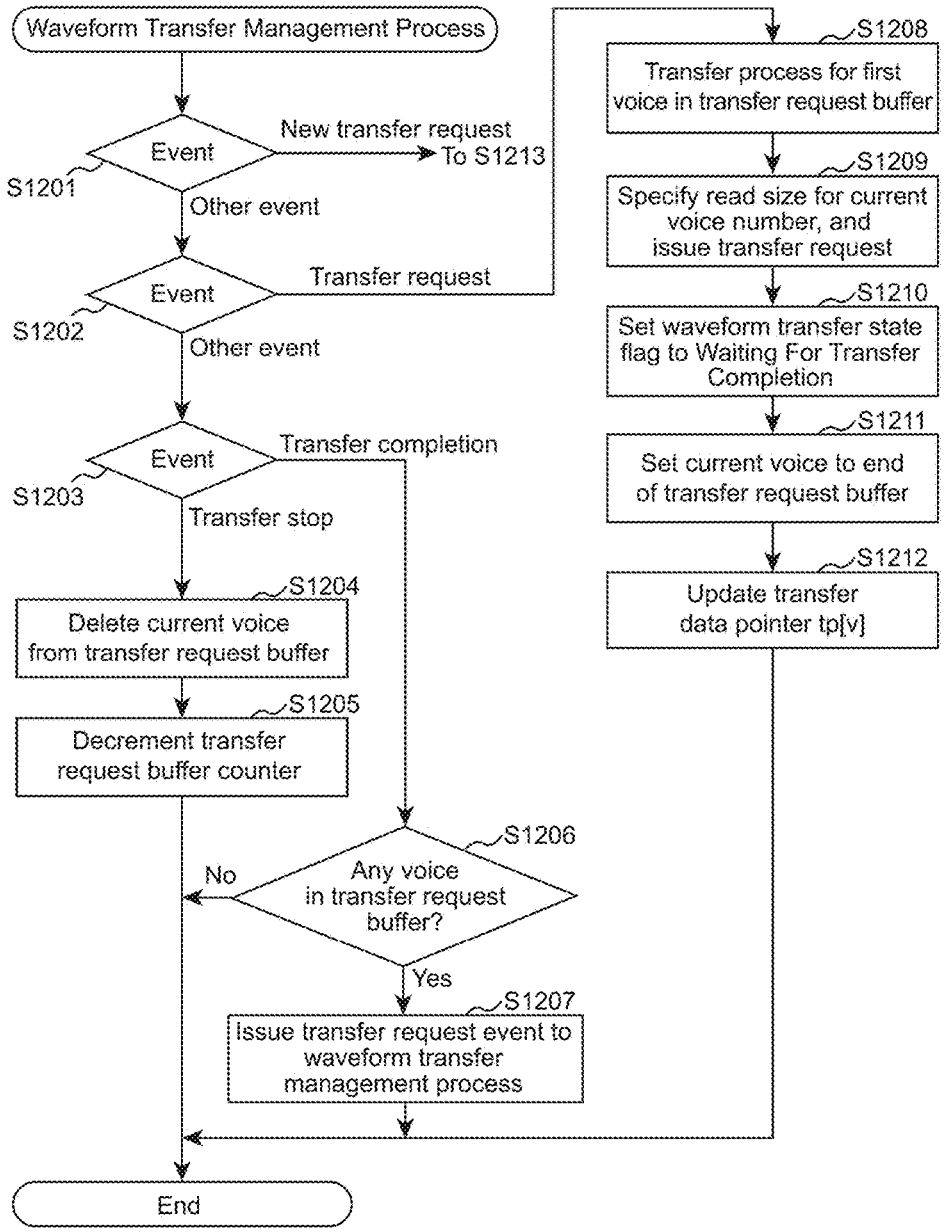
FIG. 12 is a (first) flowchart illustrating an example of a waveform transfer management process.
Figure 13:
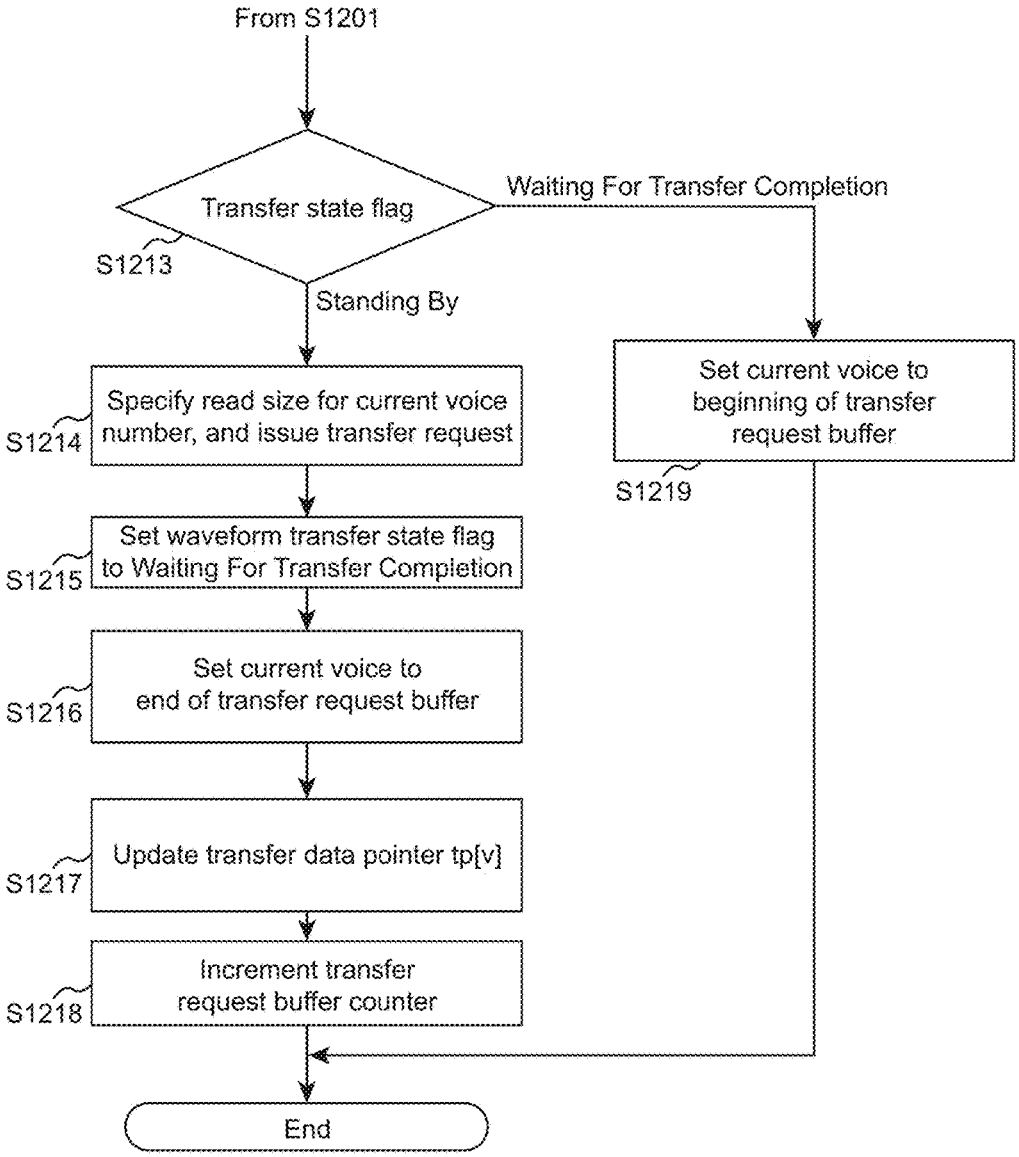
FIG. 13 is a (second) flowchart illustrating the example of the waveform transfer management process.

FIGS. 12 and 13 are flowcharts illustrating the waveform transfer management process. In steps S1201, S1202, and S1203 in FIG. 12, the CPU 205 respectively determines whether an event issued to the waveform transfer management process is a new transfer request, a transfer request, or a transfer completion or transfer stop event and then executes processes corresponding to the respective events.

When a new transfer request event is issued (see step S1109 in FIG. 11), this new transfer request event is caught by the determination in step S1201 in FIG. 12, and the process of step S1213 in FIG. 13 is executed. In step S1213, the CPU 205 checks the transfer state flag.

If it is determined in step S1213 that the transfer state flag is Waiting For Transfer Completion, this means that a waveform transfer from a tone color waveform region to a waveform buffer is currently being performed for another voice, and therefore the CPU 205 sets the current voice to be at the beginning of the transfer request buffer so that the current voice is processed upon the transfer request event immediately after the transfer completion event for that other voice (step S1219 in FIG. 13). Then, the CPU 205 ends the waveform transfer management process illustrated in the flowcharts in FIGS. 12 and 13.

Meanwhile, if it is determined in step S1213 that the transfer state flag is Standing By, the CPU 205 first specifies a read size per transfer (here, 2 pages) for the current voice number and then issues a transfer request for use in a waveform read/waveform buffer transfer process which will be described later with reference to FIG. 14A (step S1214 in FIG. 13).

Then, the CPU 205 sets the transfer state flag to Waiting For Transfer Completion (step S1215 in FIG. 13) and sets the current voice to the end of the transfer request buffer (step S1216 in FIG. 13).

Next, the CPU 205 updates a transfer data pointer tp[v] (step S1217 in FIG. 13) and increments a transfer request buffer counter (step S1218 in FIG. 13). Then, the CPU 205 ends the waveform transfer management process illustrated in the flowcharts in FIGS. 12 and 13.

When transfer of a specified amount of waveform data is completed in the waveform read/waveform buffer transfer process described below and a transfer completion request event is issued to the waveform transfer management process (step S1407 in FIG. 14A), this transfer completion request event is caught by the determination in step S1203 of FIG. 12, and the process of step S1206 in FIG. 12 is executed. In step S1206, the CPU 205 determines whether there are any voices awaiting a transfer in the transfer request buffer (that is, whether or not the transfer request buffer counter is 0).

If the determination in step S1206 yields NO, this means that all of the transfers from the tone color waveform regions to the waveform buffers have been completed (silent state), so the CPU 205 does not do anything further and immediately ends the current waveform transfer management process illustrated in the flowcharts in FIGS. 12 and 13.

If the determination in step S1206 yields YES, the CPU 205 issues a transfer request event to the waveform transfer management process so that the next voice is processed (step S1207) and then ends the current waveform transfer management process illustrated in the flowcharts in FIGS. 12 and 13.

Once a transfer request event is issued to the waveform transfer management process by the process of step S1207 in FIG. 12 as described above, this transfer request event is caught by the determination in step S1202 of FIG. 12, and the process of step S1208 in FIG. 12 is executed. In step S1208, the CPU 205 executes a transfer process for the first voice in the transfer request buffer. Here, the write pointer wp[v] and the read pointer rp[v] are checked, and if performing a transfer to the waveform buffer v would result in the write pointer wp[v] passing the read pointer rp[v], that voice v is set to the end of the transfer request buffer, and the process is performed on the second voice from the beginning of the transfer request buffer.

Next, the CPU 205 specifies a read size per transfer (here, 2 pages) for the current voice number and then issues a transfer request for use in the waveform read/waveform buffer transfer process which will be described later with reference to FIG. 14A (step S1209 in FIG. 12).

Then, the CPU 205 sets the transfer state flag to Waiting For Transfer Completion (step S1210 in FIG. 12) and sets the current voice to the end of the transfer request buffer (step S1211 in FIG. 12).

Next, the CPU 205 updates the transfer data pointer tp[v] (step S1212 in FIG. 12). Then, the CPU 205 ends the waveform transfer management process illustrated in the flowcharts in FIGS. 12 and 13.

When a transfer stop event is issued to the waveform transfer management process in the sound source event process described later (step S1413 in FIG. 14B), none of the previously described determinations in steps S1201, S1202, or S1203 in FIG. 12 are triggered, so step S1204 is executed. In this case, sound production is stopped and the waveform read operation is stopped, so the CPU 205 deletes the current voice from the transfer request buffer (step S1204) and decrements the transfer request buffer counter (step S1205). Then, the CPU 205 ends the waveform transfer management process illustrated in the flowcharts in FIGS. 12 and 13.

Figure 14A:
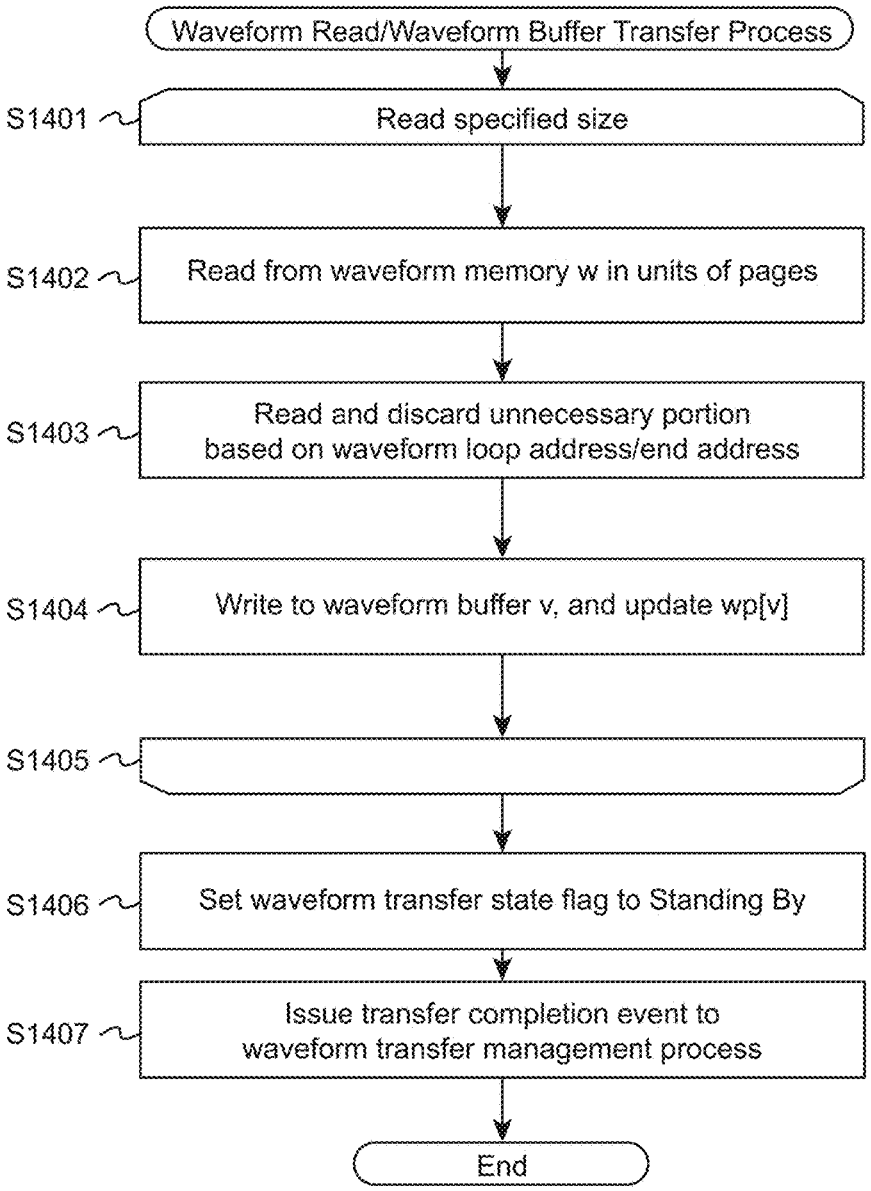
FIG. 14A is a flowchart illustrating an example of a waveform read/waveform buffer transfer process.

FIG. 14A is a flowchart illustrating the waveform read/waveform buffer transfer process. The process in this flowchart is triggered by a transfer request event issued in step S1214 in FIG. 13 or step S1209 in FIG. 12.

Steps S1401 and S1405 respectively represent the beginning and the end of a looped process. Using looping control processes in steps S1401 and S1405, the CPU 205 repeatedly executes the following sequence of processes from step S1402 to S1404 a number of times corresponding to the specified size specified in the waveform transfer management process (step S1214 in FIG. 13 or step S1209 in FIG. 12).

First, in step S1402, the CPU 205 reads waveform data in units of pages from a tone color waveform region w of the high-capacity flash memory 208 on the basis of the transfer data pointer tp[v].

Next, in step S1403, the CPU 205 considers the waveform buffer loop address and the waveform buffer end address, and, if performing a looped reading, reads and discards the unnecessary portion.

Then, in step S1404, the CPU 205 writes the waveform data read from the tone color waveform region w in steps S1402 and S1403 to an address corresponding to the write pointer wp[v] for the waveform buffer v. The CPU 205 also updates the write pointer wp[v] by an amount equal to the size of the data written.

Next, the CPU 205 sets the transfer state flag to Standing By (step S1406) and issues a transfer completion event to the waveform transfer management process described above (step S1407). Finally, the CPU 205 ends the waveform read/waveform buffer transfer process illustrated in the flowchart in FIG. 14A.

Figure 14B:
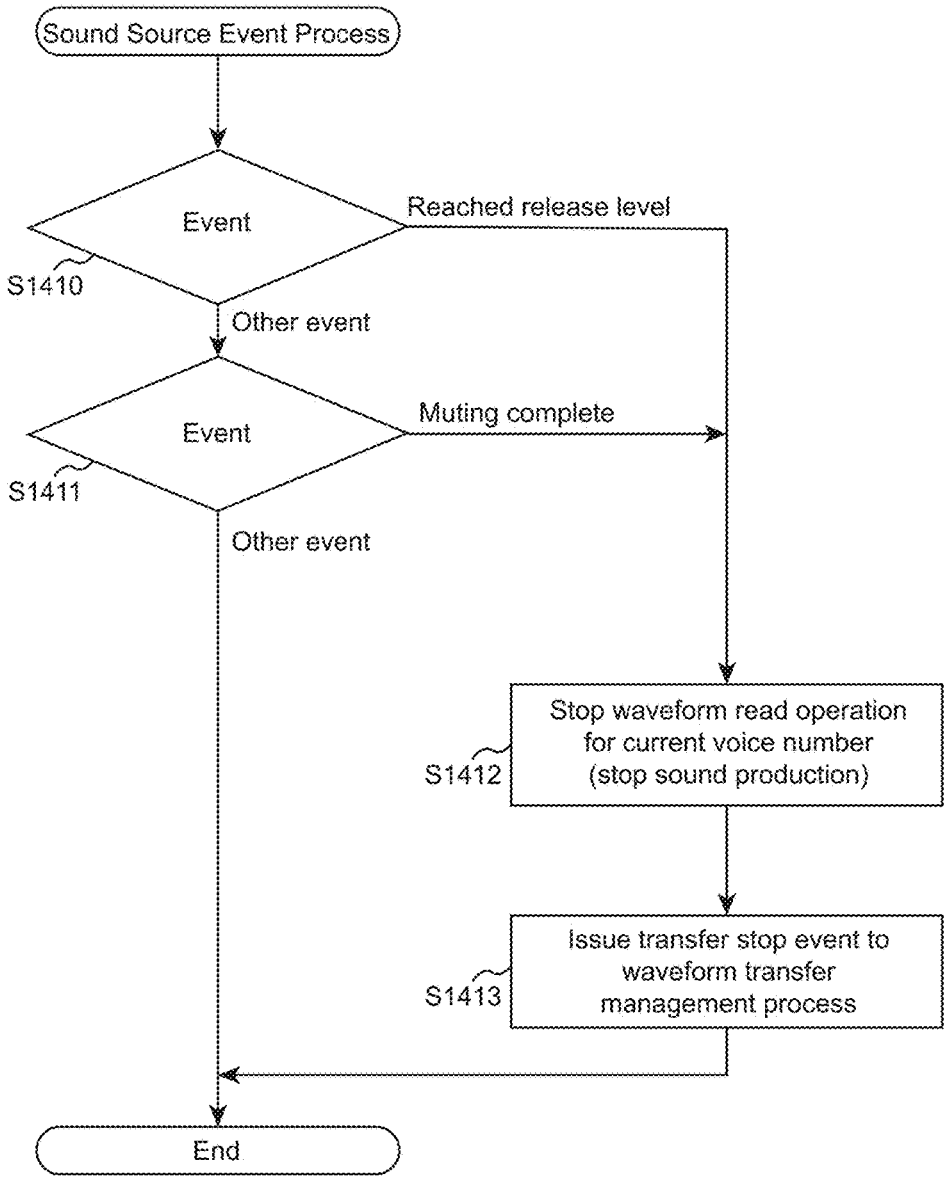
FIG. 14B is a flowchart illustrating an example of a sound source event process.

FIG. 14B is a flowchart illustrating a detailed example of the sound source event process of step S910 in FIG. 9. Here, if a voice which has transitioned to a released state due to the key release process of step S909 in FIG. 9, which is illustrated in FIG. 10C, has reached a release level (that is, if the determination in step S1410 yields YES), or if a voice has reached a mute level due to the muting process (that is, if the determination in step S1411 yields YES), the CPU 205 stops the waveform read operation (stops sound production) for that voice (step S1412) and then issues a transfer stop event to the waveform transfer management process described above (step S1413). Then, the CPU 205 ends the sound source event process of step S910 in FIG. 9, which is illustrated in the flowchart in FIG. 14B.

Figure 15A:
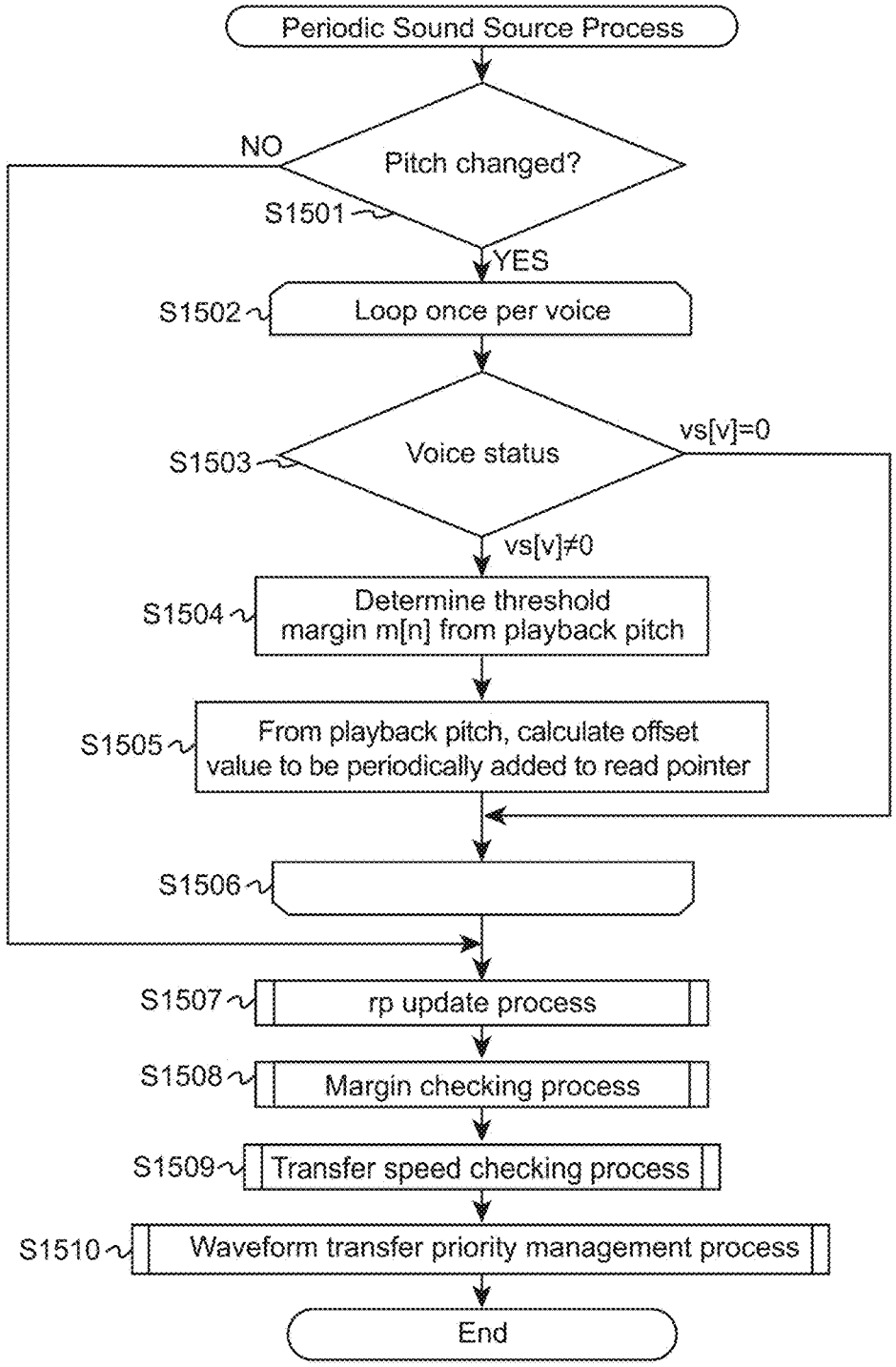
FIG. 15A is a flowchart illustrating a detailed example of a periodic sound source process.

FIG. 15A is a flowchart illustrating a detailed example of the periodic sound source process of step S911 in FIG. 9. Upon detecting a pitch change via the A/D converter 213 illustrated in FIG. 2 due to operation of the bender/modulation wheels 104 illustrated in FIG. 1 (that is, when the determination in step S1501 yields YES), the CPU 205 uses repeating control processes in steps S1502 and S1506 to repeatedly execute the following sequence of processes from step S1503 to step S1505 a number of times equal to the number of voices (the number of sound production channels n, $0 \le n \le 255$).

First, for any voice for which the voice status is anything other than Not In Use, the CPU 205 performs the operation given above by equation (2) to calculate the threshold margin m[n] based on the playback pitch of the current voice after the pitch change (step S1503→S1504).

Next, the CPU 205 recalculates the offset value which will be needed in the update process for the read pointer rp[v] and which will be periodically added to that read pointer rp[v] (step S1505).

For any voice for which the voice status is Not In Use, the CPU 205 skips the processes of steps S1504 and S1505 (step S1503→S1506).

After completing this sequence of processes a number of times equal to the number of voices, the CPU 205 executes the read pointer rp update process (step S1507), a waveform read margin checking process (step S1508), a transfer speed checking process (step S1509), and a waveform transfer priority management process (step S1510), which are respectively described below, and then ends the periodic sound source process of step S911 in FIG. 9, which is illustrated in the flowchart in FIG. 15A.

Figure 15B:
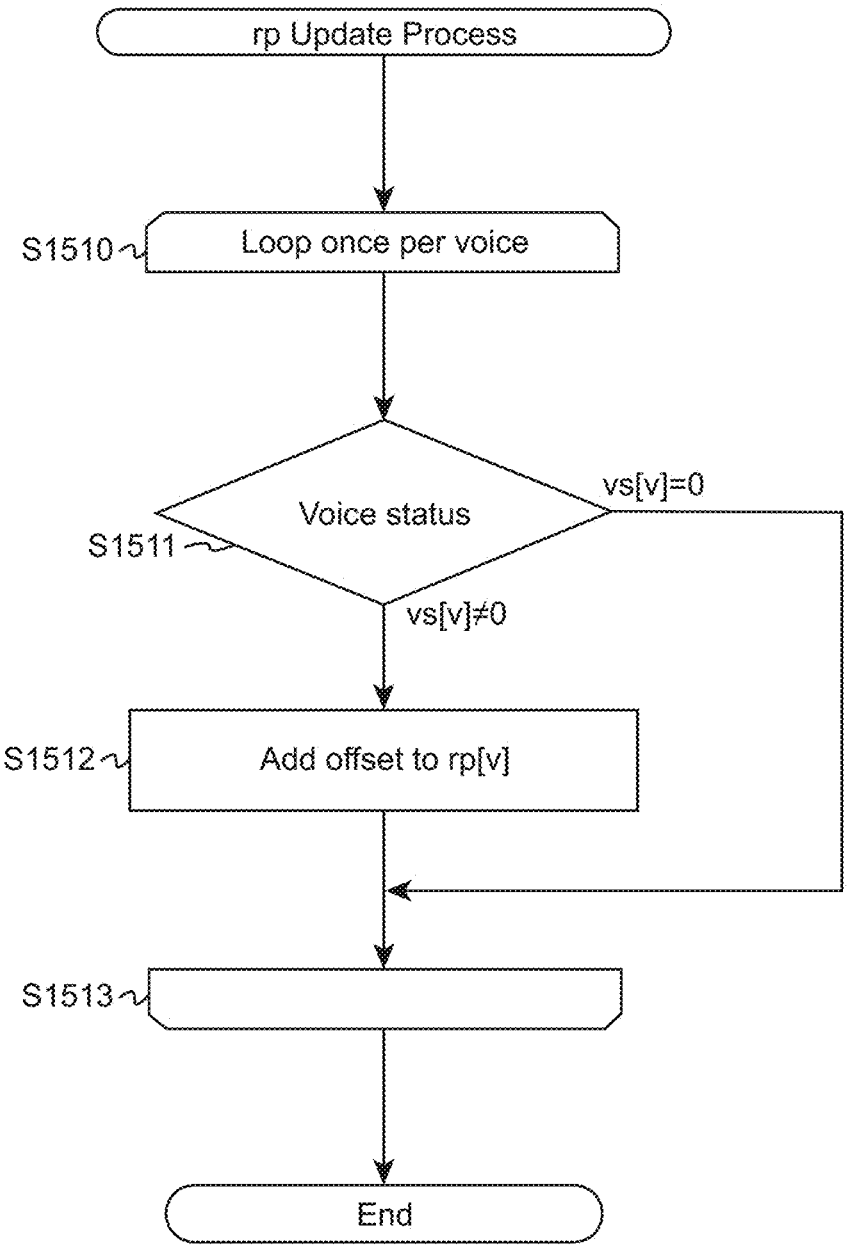
FIG. 15B is a flowchart illustrating a detailed example of an rp update process.

FIG. 15B is a flowchart illustrating a detailed example of the read pointer rp[v] update process (rp update process) of step S1507 in FIG. 15A. Here, using repeating control processes in step S1510 and S1513, the CPU 205 repeatedly executes the following sequence of processes from step S1511 to step S1512 a number of times equal to the number of voices (the number of sound production channels n, $0 \le n \le 255$).

First, for any voice for which the voice status is anything other than Not In Use, the CPU 205 adds the offset value "offset" to the read pointer rp[v] (step S1511→S1512). For any voice for which the voice status is Not In Use, the CPU 205 skips the process of step S1512.

After completing this sequence of processes a number of times equal to the number of voices, the CPU 205 ends the read pointer rp[v] update process (rp update process) of step S1507 in FIG. 15A, which is illustrated in the flowchart in FIG. 15B.

Figure 16:
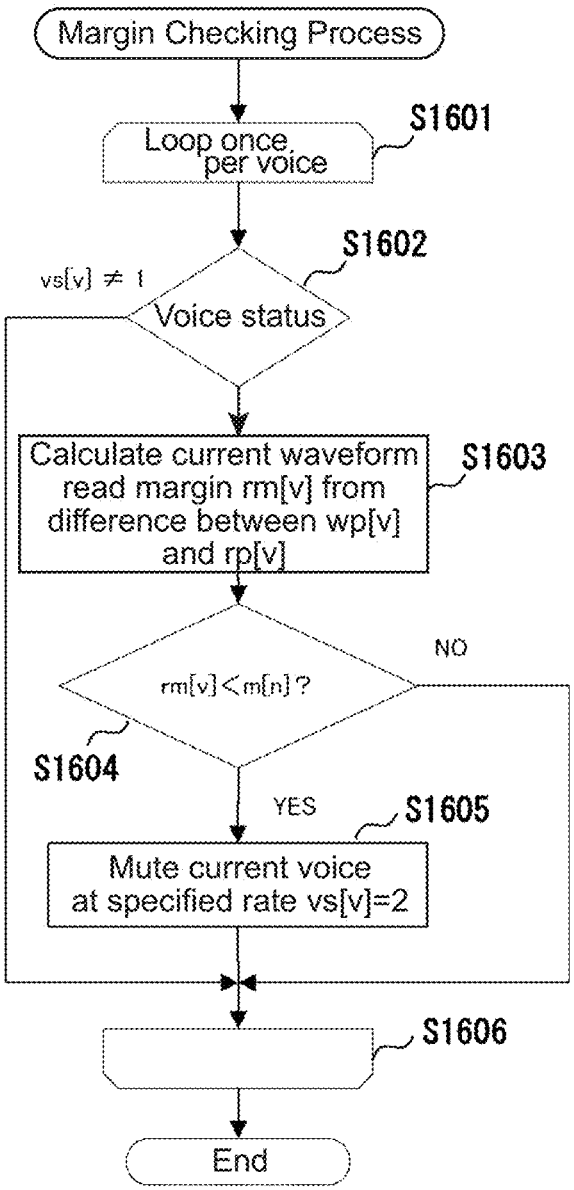
FIG. 16 is a flowchart illustrating a detailed example of a margin checking process.

FIG. 16 is a flowchart illustrating a detailed example of the margin checking process of step S1508 in FIG. 15A. This process achieves the first characteristic operation of the present embodiment as described above.

Steps S1601 and S1606 respectively represent the beginning and the end of a looped process. Using repeating control processes in steps S1601 and S1606, the CPU 205 repeatedly executes the following sequence of processes from step S1602 to step S1605 a number of times equal to the number of voices (the number of sound production channels n, $0 \le n \le 255$).

First, for any voice for which the voice status is Generating Sound, the CPU 205 performs the operation given above by equation (1) to calculate the waveform read margin rm[v] based on the difference between the write pointer wp[v] and the read pointer rp[v] (step S1602→S1603).

Next, the CPU 205 compares the waveform read margin rm[v] calculated in step S1603 to the threshold margin m[n] calculated in step S1106 in FIG. 11 or in step S1504 in FIG. 15A (step S1604).

If the waveform read margin rm[v] is less than the threshold margin m[n], the CPU 205 issues an instruction to, at a rate specified in advance, apply the muting process to the sound production channel n for the corresponding voice for which the sound source LSI 206 is currently generating sound (step S1605). If the value of the waveform read margin rm[v] is greater than or equal to the threshold margin m[n], the CPU 205 skips the process of step S1605.

After completing this sequence of processes a number of times equal to the number of voices, the CPU 205 ends the margin checking process of step S1508 in FIG. 15A, which is illustrated in the flowchart in FIG. 16.

Figure 17A:
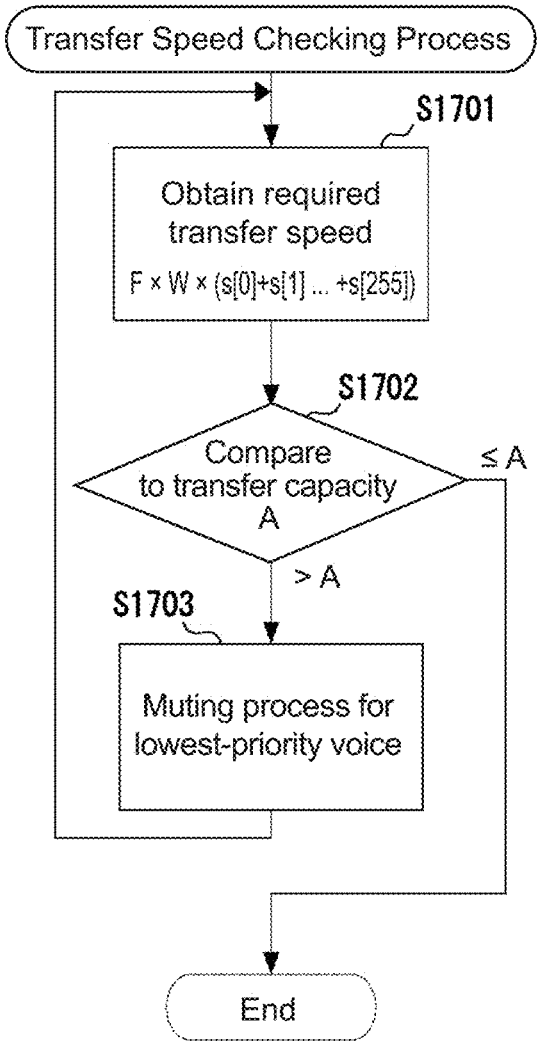
FIG. 17A is a flowchart illustrating an example of a transfer speed checking process.

FIG. 17A is a flowchart illustrating a detailed example of the transfer speed checking process of step S1509 in FIG. 15A. This process achieves the third characteristic operation of the present embodiment as described above.

Here, the CPU 205 performs the operation given above by equation (3) to calculate the required transfer speed needed for all of the sound production channels n (0≤n≤255) corresponding to all of the waveform readers 305 numbered from #0 to #255 as illustrated in FIG. 3 (step S1701).

Next, the CPU 205 determines whether the required transfer speed calculated in step S1701 exceeds the system transfer capacity A, which is configured in advance (step S1702).

Upon determining in step 1702 that the required transfer speed has exceeded the transfer capacity A, the CPU 205 issues an instruction to apply the muting process to the waveform reader 305 (see FIG. 3) within the sound source LSI 206 which corresponds to the sound production channel for the voice having the lowest priority. Here, the CPU 205 determines this priority on the basis of factors such as sound production start order and sound emission level, for example (all as part of steps S1702→S1703).

Next, the CPU 205 returns to the process of step S1701 and recalculates the required transfer speed, compares that required transfer speed to the transfer capacity A (step S1702), and repeatedly executes this sequence of processes (that is, repeats the sequence of step S1702→step S1703→step 1701→step 1702) until the required transfer speed becomes less than or equal to the transfer capacity A and it is successfully determined in step S1702 that the required transfer speed is less than or equal to the transfer capacity A.

Upon determining in step S1702 that the required transfer speed has become less than or equal to the transfer capacity A, the CPU 205 ends the transfer speed checking process of step S1509 in FIG. 15A, which is illustrated in the flowchart in FIG. 17A (step S1702→End).

Figure 17B:
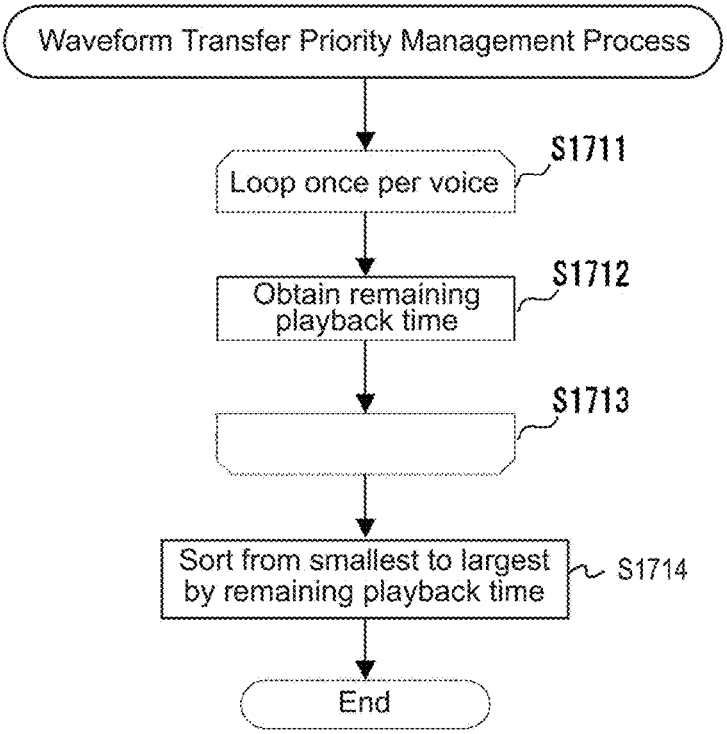
FIG. 17B is a flowchart illustrating an example of a waveform transfer priority management process.

FIG. 17B is a flowchart illustrating a detailed example of the waveform transfer priority management process of step S1510 in FIG. 15A. This process achieves the second characteristic operation of the present embodiment as described above.

Using repeating control processes in steps S1711 and S1713, the CPU 205 repeatedly executes the following process of step S1712 a number of times equal to the number of voices (the number of sound production channels n, 0≤n≤255).

In step S1712, the CPU 205 uses the write pointer wp[v] and the read pointer rp[v] for the waveform buffer v for the sound production channel n corresponding to the current voice as well as the associated threshold margin m[n] calculated using the operation given above by equation (2) in order to calculate the remaining playback time for that voice.

Once this process has been completed a number of times equal to the number of voices, the CPU 205 sorts the voice numbers (0≤n≤255) currently registered in the transfer request buffer described above (see step S1214 in FIG. 13 or step S1208 in FIG. 12) in order from smallest to largest by the remaining playback times calculated by repeating step S1712 (step S1713→S1714). Finally, the CPU 205 ends the waveform transfer priority management process of step S1510 in FIG. 15A, which is illustrated in the flowchart in FIG. 17B.

In step S1214 (FIG. 13) or step S1208 (FIG. 12) of the waveform transfer management process described above, the transfer processes from the waveform memories w in the high-capacity flash memory 208 to the waveform buffers v in the RAM 204 are performed in order starting from the first voice (that is, the voice with the shortest remaining playback time) in the transfer request buffer in which the voices are sorted as described above.

Figure 17C:
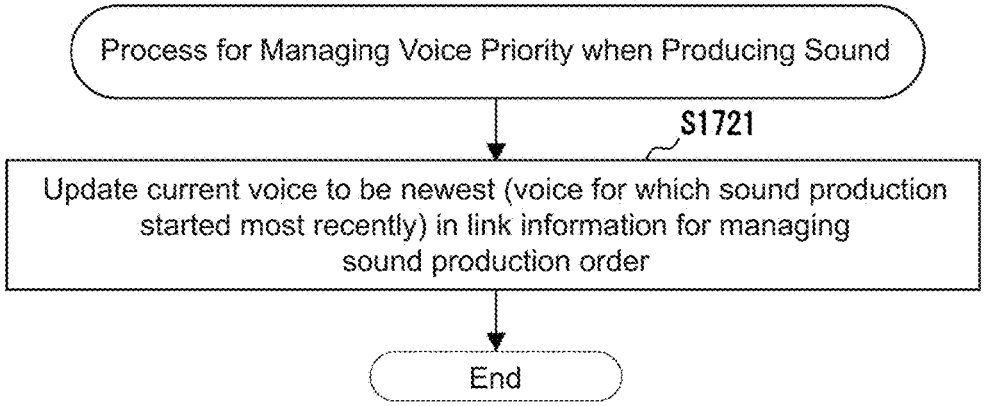
FIG. 17C is a flowchart illustrating an example of a process for managing voice priority when producing sound.

FIG. 17C is a flow of oscillator priority management for during voice sound production. The CPU 205 executes the process in the flowchart in FIG. 17C when the keypress process issues a sound production instruction for a new voice (step S1109 in FIG. 11→step S1201 in FIG. 126→step S1213→S1214 in FIG. 13). In this process, the CPU 205 works on link information for managing the sound production order of the voices and updates this link information to set the current voice to be the newest (that is, the voice for which sound production started most recently) (step S1721).

Figure 18:
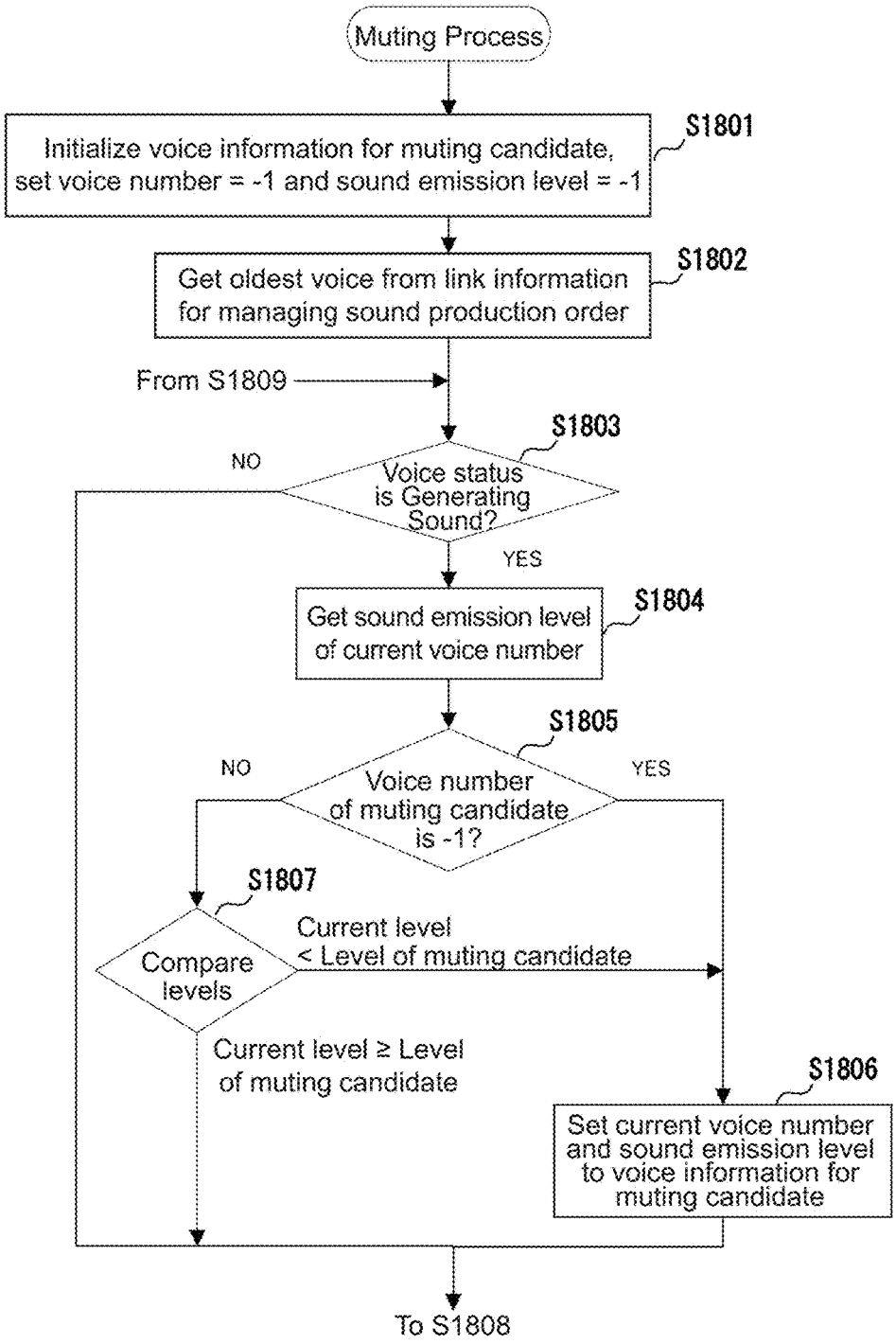
FIG. 18 is a (first) flowchart illustrating a detailed example of a lowest-priority voice muting process.
Figure 19:
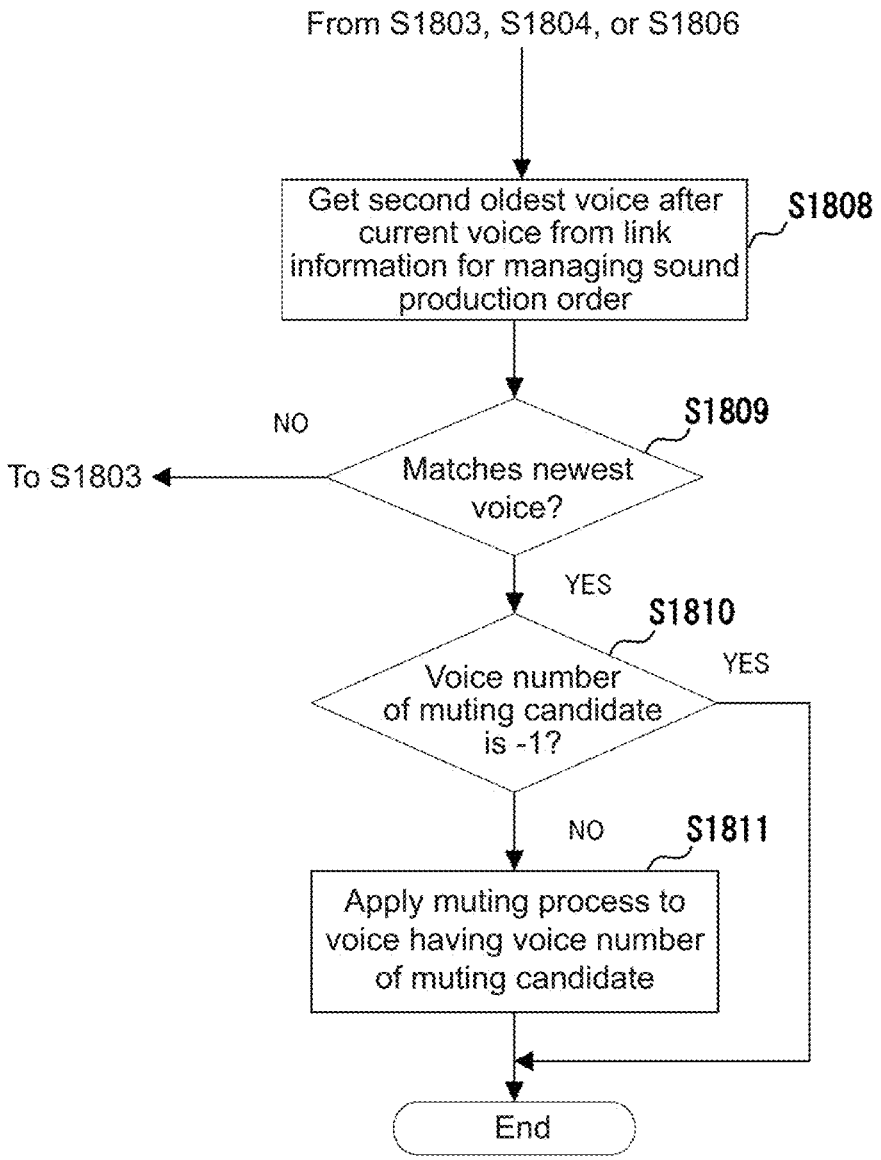
FIG. 19 is a (second) flowchart illustrating the detailed example of the lowest-priority voice muting process.

FIGS. 18 and 19 are flowcharts illustrating a detailed example of the muting process for the lowest-priority voice in step S1703 of FIG. 17A. The flow of this muting process is based on voice priority. First, the CPU 205 initializes voice information for the candidate for the muting process. Here, the CPU 205 respectively sets a voice number and a sound emission level to values of −1 so as to be undetermined in the initial state (step S1801 in FIG. 18).

Next, the CPU 205 identifies the voice for which sound production started longest ago from the link information for managing the sound production order of the voices (step S1802 in FIG. 18).

Then, the CPU 205 checks whether the status of the voice obtained in step S1802 is Generating Sound (step S1803 in FIG. 18).

If the status of the obtained voice is not Generating Sound (that is, if the determination in step S1803 yields NO), the CPU 205 proceeds to the process of step S1808 in FIG. 19, which will be described later.

Meanwhile, if the status of the obtained voice is Generating Sound (that is, if the determination in step S1803 yields YES), the CPU 205 gets the sound emission level (volume or the like) of the current voice (i.e., currently identified voice) (step S1804).

Next, the CPU 205 determines whether the voice number in the voice information for the muting candidate is undetermined (has a value of −1) (step S1805).

If the voice number is undetermined (that is, if the determination in step S1805 yields YES), the CPU 205 sets the current voice number and sound emission level to the voice information for the muting candidate (step S1805→S1806). Then, the CPU 205 proceeds to the process of step S1808 in FIG. 19.

Meanwhile, if the voice number is not undetermined and a voice number has already been configured in the voice information for the muting candidate (that is, if the determination in step S1805 yields NO), the CPU 205 compares the sound emission level of the current voice obtained in step S1808 of FIG. 19 (described below) to the sound emission level configured in the voice information for the muting candidate (step S1807).

If the comparison in step S1807 indicates that the sound emission level of the current voice is less than the sound emission level configured in the voice information for the muting candidate, the CPU 205 sets the current voice number and sound emission level to the voice information for the muting candidate (step S1807→S1806). Then, the CPU 205 proceeds to the process of step S1808 in FIG. 19.

Repeating these processes from step S1803 to S1809 while the sound source is respectively reading and outputting the waveform data stored in the plurality of waveform buffer regions in the second memory makes it possible to execute the silencing process on sounds on the basis of which waveform data currently has the smallest output level among all of the waveform data, for example.

Meanwhile, if the comparison in step S1807 indicates that the sound emission level of the current voice is greater than or equal to the sound emission level configured in the voice information for the muting candidate, the CPU 205 proceeds to the process of step S1808 in FIG. 19.

In step S1808 of FIG. 19, the CPU 205 obtains, from the link information for managing the sound production order of the voices, the voice number of the voice for which sound production started second longest ago after that for the currently identified oldest voice (step S1808 in FIG. 19).

Next, the CPU 205 determines whether that second (or next) oldest voice number obtained in step S1808 matches the newest voice number (that is, the voice for which sound production started most recently) (step S1809).

If the determination in step S1809 yields NO, the CPU 205 repeats the sequence of processes from step S1803 in FIG. 18 to step S1808 in FIG. 19 until the next oldest voice number obtained in step S1808 matches the newest voice number.

Once the next oldest voice number obtained in step S1808 matches the newest voice number (that is, once the determination in step S1809 yields YES), the CPU 205 proceeds to determine whether the voice number in the voice information for the muting candidate is undetermined (has a value of −1) (step S1810).

If the voice number is not undetermined and a voice number has already been configured in the voice information for the muting candidate (that is, if the determination in step S1810 yields NO), the CPU 205 issues an instruction to apply the muting process to the waveform reader 305 (see FIG. 3) within the sound source LSI 206 which corresponds to the sound production channel for the voice having that voice number (step S1811). Then, the CPU 205 ends the muting process for the lowest-priority voice of step S1703 in FIG. 17A and illustrated in the flowcharts in FIGS. 18 and 19.

Meanwhile, if the voice number is undetermined (that is, if the determination in step S1810 yields YES), this means that there are no voices in the Generating Sound state, so the CPU 205 does not execute the muting process and simply ends the muting process for the lowest-priority voice of step S1703 in FIG. 17A, which is illustrated in the flowcharts in FIGS. 18 and 19.

In the first characteristic operation of the present embodiment as described above, the faster the playback speed of the waveform data (the speed at which the sound source reads that waveform data) becomes (that is, the higher the pitch of the musical sound to be played becomes relative to that of the original sound), the greater the threshold margin m[n] becomes relative to a standard threshold margin, and the greater the speed at which the read pointer rp[v] catches up with the write pointer wp[v] becomes even if the allowable range relative to the waveform read margin rm[v] is somewhat large. Therefore, the muting determination is made at a threshold margin m[n] which is greater than normal, thereby making it possible to maintain sufficient margin for during the muting process. Conversely, when the playback speed of the waveform data is low (that is, when the pitch of the musical sound to be played is lower than that of the original sound), the margin for during the muting process can be reduced by an amount proportional to the reduction in read speed. This control operation makes it possible to improve waveform data transfer efficiency and also makes it possible to prevent musically unacceptable sounds from being emitted.

Next, in the second characteristic operation of the present embodiment, the amount of data stored in the waveform buffers v is converted to equivalent time values, and waveform transfers are performed in a prioritized manner starting from the waveform buffer v having the most urgent need. Thus, deviations in playback time between the sound production channels proceed to be eliminated, which averages the risk of a transfer not being completed in time across the sound production channels and thereby makes it possible to substantially eliminate any unnecessary muting. Moreover, although this approach can result in transfers being wasted when performed for sound production channels for which waveform reads (and sound production) become unnecessary midway due to a key having been released, averaging the expected values of these transfer losses as well makes it possible to prevent large transfer losses and to achieve stable waveform transfers.

Furthermore, in the third characteristic operation of the present embodiment, the maximum waveform transfer capacity of the system and the total amount of waveform data being requested by the sound source LSI (that is, the required transfer speed) are continuously compared, and when it is determined that a transfer will not be completed in time if the current state continues, sound production begins to be stopped starting from the sounds with the least musical importance. This makes it possible to minimize the amount of musical damage associated with stopping sound production for a given number of sound production channels.

Although specific embodiments of the present invention were described above, the present invention is not limited to the embodiments described above, and various modifications can be made without departing from the spirit of the invention. Moreover, the fact that various changes and modifications can be made to the present invention without departing from the spirit and scope thereof is obvious to a person skilled in the art. Therefore, the present invention is intended to encompass all such changes and modifications that are made within the scope of the appended claims and their equivalents. In particular, it is explicitly contemplated that any one or more components from any two or more of the embodiments described above and various modifications thereof can be combined and still be regarded as being within the scope of the present invention.

What is claimed is:

1. An electronic musical instrument, comprising:

a first memory storing a plurality of waveform data;

a second memory having a plurality of waveform buffer regions that respectively function as ring buffers;

a processor that executes a transfer process of transferring the waveform data stored in the first memory to the waveform buffer regions in the second memory; and a sound source that executes a read process of reading waveform data from the plurality of waveform buffer regions in the second memory and causing a plurality of sounds to be generated simultaneously based on the waveform data read from the plurality of waveform buffer regions in the second memory, wherein the transfer process by the processor and the read process by the sound source are executed in a ring buffer operational manner using the waveform buffer regions as ring buffers, respectively, and wherein each of the following processes is executed by the processor or the sound source:

a threshold margin value setting process of setting a plurality of threshold margin values respectively for the plurality of waveform buffer regions, the plurality of threshold margin values being settable to values specific to the corresponding waveform buffer regions and at least some of the threshold margin values are different from each other;

an identification process of identifying, at a prescribed timing, among the plurality of waveform buffer regions, a waveform buffer region in which a waveform read margin calculated for said waveform buffer region reaches the threshold margin value set and assigned to said waveform buffer region, the waveform read margin being calculated for each waveform buffer region at the prescribed timing based on a transfer position in the waveform buffer region to which the processor is transferring waveform data from the first memory at the prescribed timing and a read position in the waveform buffer region from which the sound source is reading waveform data in the read processes; and a sound generation stopping process of stopping a sound that has been generated from the waveform data read from the waveform buffer region that is identified by the identified process, thereby stopping the read process on the identified waveform buffer region by the sound source.

2. The electronic musical instrument according to claim 1, wherein in the threshold margin value setting process, the threshold margin value for a waveform buffer region from which the sound source reads the waveform data at a first speed is set larger than the threshold margin value for a waveform buffer region from which the sound source reads the waveform data at a second speed that is slower than the first speed.

3. The electronic musical instrument according to claim 1, wherein one of the processor and the sound source further executes an overall transfer rate determination process of determining whether an overall transfer rate needed for all of the plurality of waveform buffer regions to be performed in the transfer process by the processor has reached an overall transfer capacity threshold, and wherein when the overall transfer rate is determined to have reached the overall transfer capacity threshold in the transfer rate determination process, one of the processor and the sound source causes the read process on at least one of the waveform buffer regions by the sound source to be stopped.

4. The electronic musical instrument according to claim 3, wherein in order to determine said at least one of the waveform buffer regions, said one of the processor and the sound source selects a waveform buffer region that has waveform data for a sound that has a low musical priority, the low musical priority being determined on the basis of at least one of an order in which the sound source started the read process and an output sound level at which the sound is output.

5. The electronic musical instrument according to claim 3, wherein in order to determine said at least one of the waveform buffer regions, said one of the processor and the sound source selects a waveform buffer region that has waveform data for a sound having a lowest output level.

6. The electronic musical instrument according to claim 1, wherein one of the processor and the sound source further executes a waveform data transfer priority determination process of, on the basis of read speeds at which the sound source respectively reads the plurality of waveform buffer regions, determining priorities for the waveform buffer regions according to which the processor transfer waveform data from the first memory.

7. The electronic musical instrument according to claim 6, wherein in the waveform data transfer priority determination process, between the waveform buffer region having waveform data that is played back at a first playback speed and the waveform buffer region having waveform data that is played back at a second playback speed lower than the first playback speed, the waveform buffer region with the first playback speed is given a higher priority than the second waveform buffer region with the second playback speed so that the processor prioritizes the transfer of waveform data from the first memory to the waveform buffer region with the first playback speed relative to the transfer of waveform data from the first memory to the waveform buffer region with the second playback speed.

8. A method executed by an electronic musical instrument that includes:

a first memory storing a plurality of waveform data;

a second memory having a plurality of waveform buffer regions that respectively function as ring buffers;

a processor that executes a transfer process of transferring the waveform data stored in the first memory to the waveform buffer regions in the second memory; and a sound source that executes a read process of reading waveform data from the plurality of waveform buffer regions in the second memory and causing a plurality of sounds to be generated simultaneously based on the waveform data read from the plurality of waveform buffer regions in the second memory, the transfer process by the processor and the read process by the sound source being executed in a ring buffer operational manner using the waveform buffer regions as ring buffers, respectively, the method comprising:

causing one of the processor and the sound source to execute a threshold margin value setting process of setting a plurality of threshold margin values respectively for the plurality of waveform buffer regions, the plurality of threshold margin values being settable to values specific to the corresponding waveform buffer regions and at least some of the threshold margin values are different from each other;

causing one of the processor and the sound source to execute an identification process of identifying, at a prescribed timing, among the plurality of waveform buffer regions, a waveform buffer region in which a waveform read margin calculated for said waveform buffer region reaches the threshold margin value set and assigned to said waveform buffer region, the waveform read margin being calculated for each waveform buffer region at the prescribed timing based on a transfer position in the waveform buffer region to which the processor is transferring waveform data from the first memory at the prescribed timing and a read position in the waveform buffer region from which the sound source is reading waveform data in the read processes; and causing one of the processor and the sound source to execute a sound generation stopping process of stopping a sound that has been generated from the waveform data read from the waveform buffer region that is identified by the identified process, thereby stopping the read process on the identified waveform buffer region by the sound source.

9. A computer-readable non-transitory storage medium having stored thereon a program to be executable by an electronic musical instrument that includes:

a first memory storing a plurality of waveform data;

a second memory having a plurality of waveform buffer regions that respectively function as ring buffers;

a processor that executes a transfer process of transferring the waveform data stored in the first memory to the waveform buffer regions in the second memory; and a sound source that executes a read process of reading waveform data from the plurality of waveform buffer regions in the second memory and causing a plurality of sounds to be generated simultaneously based on the waveform data read from the plurality of waveform buffer regions in the second memory, the transfer process by the processor and the read process by the sound source being executed in a ring buffer operational manner using the waveform buffer regions as ring buffers, respectively, the program causing the electronic musical instrument to perform the following:

causing one of the processor and the sound source to execute a threshold margin value setting process of setting a plurality of threshold margin values respectively for the plurality of waveform buffer regions, the plurality of threshold margin values being settable to values specific to the corresponding waveform buffer regions and at least some of the threshold margin values are different from each other;

causing one of the processor and the sound source to execute an identification process of identifying, at a prescribed timing, among the plurality of waveform buffer regions, a waveform buffer region in which a waveform read margin calculated for said waveform buffer region reaches the threshold margin value set and assigned to said waveform buffer region, the waveform read margin being calculated for each waveform buffer region at the prescribed timing based on a transfer position in the waveform buffer region to which the processor is transferring waveform data from the first memory at the prescribed timing and a read position in the waveform buffer region from which the sound source is reading waveform data in the read processes; and causing one of the processor and the sound source to execute a sound generation stopping process of stopping a sound that has been generated from the waveform data read from the waveform buffer region that is identified by the identified process, thereby stopping the read process on the identified waveform buffer region by the sound source.

* * * * *